US007110687B2

(12) United States Patent
Furukawa

(10) Patent No.: US 7,110,687 B2
(45) Date of Patent: Sep. 19, 2006

(54) IMAGE FORMING DEVICE

(75) Inventor: Toshio Furukawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 91 days.

(21) Appl. No.: 10/808,373

(22) Filed: Mar. 25, 2004

(65) Prior Publication Data

US 2004/0253013 A1 Dec. 16, 2004

(30) Foreign Application Priority Data

Mar. 25, 2003 (JP) ..... P2003-082792

(51) Int. Cl.
*G03G 15/00* (2006.01)

(52) U.S. Cl. ..... 399/49; 399/301

(58) Field of Classification Search ..... 399/49, 399/301, 9, 298, 299
See application file for complete search history.

(56) References Cited

U.S. PATENT DOCUMENTS

| | | | | |
|---|---|---|---|---|
| 5,510,885 | A * | 4/1996 | Mori et al. | 399/28 |
| 5,523,823 | A * | 6/1996 | Ashikaga | 399/28 |
| 5,867,759 | A * | 2/1999 | Isobe et al. | 399/301 |
| 5,881,346 | A * | 3/1999 | Mori et al. | 399/301 |
| 6,278,857 | B1 * | 8/2001 | Monji et al. | 399/301 |
| 6,408,157 | B1 * | 6/2002 | Tanaka et al. | 399/301 |
| 6,714,224 | B1 * | 3/2004 | Yamanaka et al. | 347/116 |
| 6,731,889 | B1 * | 5/2004 | Nakayama | 399/49 |
| 6,829,465 | B1 * | 12/2004 | Yamanaka et al. | 399/301 |
| 6,889,015 | B1 * | 5/2005 | Shimura | 399/49 |
| 6,903,759 | B1 * | 6/2005 | Yamanaka et al. | 347/116 |
| 6,909,858 | B1 * | 6/2005 | Hama et al. | 399/49 |
| 2002/0136570 | A1 * | 9/2002 | Yamanaka et al. | 399/301 |
| 2005/0047834 | A1 * | 3/2005 | Tomita et al. | 399/301 |

FOREIGN PATENT DOCUMENTS

| | | |
|---|---|---|
| JP | A-09-247452 | 9/1997 |
| JP | A-11-258872 | 9/1999 |
| JP | A-2001-134041 | 5/2001 |

* cited by examiner

*Primary Examiner*—R. Alexander Smith
(74) *Attorney, Agent, or Firm*—Oliff & Berridge, PLC

(57) ABSTRACT

An image forming device measures calibration patterns printed on a conveying belt and stores the measurement data, which includes data for the density and position of the patterns. Measurement data is deleted from memory when the position of the pattern matches positional data stored in a flash memory for indicating unusable or abnormal positions on the conveying belt. Next, the density data and positional data in each measurement data is checked. If either the density or positional data falls outside of a specified range, then the measurement data is considered abnormal. In this case, the pattern forming position in the measurement data is stored as positional data and the measurement data is deleted. Subsequently, color registration correction is performed based on the remaining normal measurement data.

27 Claims, 15 Drawing Sheets

IMAGE FORMING DEVICE

BACKGROUND OF THE INVENTION

1. Field of the Invention

The present invention relates to an image forming device for correcting errors in registration between monochromatic images that are superimposed to form a multicolor image.

2. Description of Related Art

Conventional image forming devices employing an electrophotographic system, such as laser printers and copy machines, perform image formation in an image forming unit provided with a photosensitive drum. The photosensitive drum includes a charge-generating layer and a charge-transporting layer formed over a base layer. A charge is applied to the photosensitive drum by a corona discharge, and the charged drum is exposed to light, such as laser light or LED (Light Emitting Diode) light, to form an electrostatic latent image on the surface of the drum. After the image is developed with toner or another developer, the developed image is transferred onto a recording medium such as paper. Image formation is completed by a fixing unit or the like that fixes the image onto the recording medium with heat.

Image forming devices employing an electrcphotographic system form color images using colored toner of cyan, magenta, yellow, black, and the like and superimposing monochromatic toner images formed of each color to form a single multicolor image. Normally, this type of image forming device is provided with an image forming unit for each color, but only one fixing unit. A monochromatic toner image formed in each image forming unit is transferred onto a recording medium either directly or via an intermediate transfer member. Registration errors among the superimposed images may occur at this time when there are alignment errors in the relative positions at which the monochromatic images are formed. To avoid this problem, these image forming devices perform a calibration process to correct any registration errors when the image forming device is first turned on and during idle times when a printing operation is not being performed, for example.

In the calibration process, the image forming unit measures the position, density, and the like of each monochromatic image formed on the intermediate transfer member, such as a transfer belt, and the image carrying member, such as a conveying belt. The image forming unit then calibrates the relative positions and adjusts the color densities of each image formed in each image forming unit, based on the results of these measurements. However, the image carrying member on which the monochromatic images are formed may suffer from wear, abrasions, or the like due to extended use and other circumstances. Monochromatic images formed over these abrasions or the like during the calibration process can adversely affect measurements.

In a calibration method described in Japanese patent-application publication (kokai) No. HEI-11-258872 (paragraph 0122), a laser beam is irradiated onto the transfer belt and the amount of light reflected off the transfer belt is measured for one cycle. The density of the monochromatic image (monitor pattern) on the transfer belt is detected at the position having the highest measured value.

SUMMARY OF THE INVENTION

However, when performing the above-described calibration process, the reflected light of the laser beam must always be measured for one complete cycle of the transfer belt in order to determine a position on the transfer belt for forming the monochromatic image. Therefore, the calibration process requires a considerable amount of time and delays the printing operation, which is an inconvenience to the user.

In view of the above-described drawbacks, it is an objective of the present invention to provide an image forming device capable of reducing the amount of time required to correct errors in color registration.

In order to attain the above and other objects, the present invention provides an image forming device for forming a multicolor image by superimposing a plurality of monochromatic images on a recording medium. The device includes an image carrying member carrying an image, a plurality of image forming units, a measuring unit, an abnormal-data excluding unit, and a color-registration correcting unit. Each of the plurality of image forming units forms a monochromatic calibration image on the image carrying member. The measuring unit measures at least one predetermined kind of information with respect to the monochromatic calibration image, thereby obtaining at least one data group of the at least one predetermined kind of information. The abnormal-data excluding unit excludes abnormal data from each of the at least one data group, thereby obtaining normal data. The color-registration correcting unit adjusts the plurality of image forming units based on the normal data, thereby correcting color registration errors among a plurality of monochromatic images.

The present invention also provides an image forming device for forming a multicolor image by superimposing a plurality of monochromatic images on a recording medium. The device includes an image carrying member carrying an image, a plurality of image forming units, a measuring unit, an abnormal-position storing unit, and a color-registration correcting unit. Each of the plurality of image forming units forms a monochromatic calibration image on the image carrying member. The measuring unit measures at least one predetermined kind of information with respect to the monochromatic calibration image, thereby obtaining measurement data of the monochromatic calibration image. The abnormal-position storing unit stores positional data of a position at which the measurement data is abnormal. The color-registration correcting unit adjusts the plurality of image forming units based on the measurement data whose positional data is not stored in the abnormal-position storing unit, thereby correcting color registration errors among a plurality of monochromatic images.

The present invention also provides an image forming device for forming a multicolor image by superimposing a plurality of monochromatic images on a recording medium. The device includes an image carrying member carrying an image, a plurality of image forming units, a measuring unit, a measurement-data determining unit, and a color-registration correcting unit. Each of the plurality of image forming units forms a monochromatic calibration image on the image carrying member. The measuring unit measures at least one predetermined kind of information with respect to the monochromatic calibration image, thereby obtaining measurement data of the monochromatic calibration image. The measurement-data determining unit determines whether the measurement data is either normal data or abnormal data. The color-registration correcting unit adjusts the plurality of image forming units based on the normal data by excluding the abnormal data, thereby correcting color registration errors among a plurality of monochromatic images.

The present invention also provides an image forming device for forming a multicolor image by superimposing a plurality of monochromatic images on a recording medium.

The device includes an image carrying member carrying an image, a plurality of image forming units, a position detecting unit, a measuring unit, a measurement-data determining unit, and an abnormal-position storing unit. Each of the plurality of image forming units forms a monochromatic calibration image on the image carrying member. The position detecting unit detects a position of the monochromatic calibration image on the image carrying member. The measuring unit measures at least one predetermined kind of information with respect to the monochromatic calibration image, thereby obtaining measurement data of the monochromatic calibration image. The measurement-data determining unit determines whether the measurement data is either normal data or abnormal data. The abnormal-position storing unit stores positional data of the position of the monochromatic calibration image at which the measurement-data determining unit has determined that the measurement data is the abnormal data.

The present invention also provides an image forming device for forming a multicolor image by superimposing a plurality of monochromatic images on a recording medium. The device includes an image carrying member carrying an image, an abnormal-position storing unit, a plurality of image forming units, a measuring unit, and a color-registration correcting unit. The abnormal-position storing unit stores positional data of a position at which measurement data of a monochromatic calibration image on the image carrying member is abnormal. Each of the plurality of image forming units forms the monochromatic calibration image on the image carrying member, while avoiding the position whose positional data is stored in the abnormal-position storing unit. The measuring unit measures at least one predetermined kind of information with respect to the monochromatic calibration image, thereby obtaining the measurement data of the monochromatic calibration image. The color-registration correcting unit adjusts the plurality of image forming units based on the measurement data obtained by the measuring unit, thereby correcting color registration errors among a plurality of monochromatic images.

BRIEF DESCRIPTION OF THE DRAWINGS

The above and other objects, features and advantages of the invention will become more apparent from reading the following description of the preferred embodiments taken in connection with the accompanying drawings in which:

FIG. 12(*b*) is an explanatory diagram showing the state of the photosensitive drums after adjusting the phase shift caused by the eccentricity of the photosensitive drums:

FIG. 13(*b*) is an explanatory diagram showing the photosensitive drum and showing each rotational angle corresponding to each length between the reference point and each calibration pattern;

DETAILED DESCRIPTION OF THE PREFERRED EMBODIMENTS

An image forming device according to a preferred embodiment of the present invention will be described while referring to the accompanying drawings.

Figure 1:
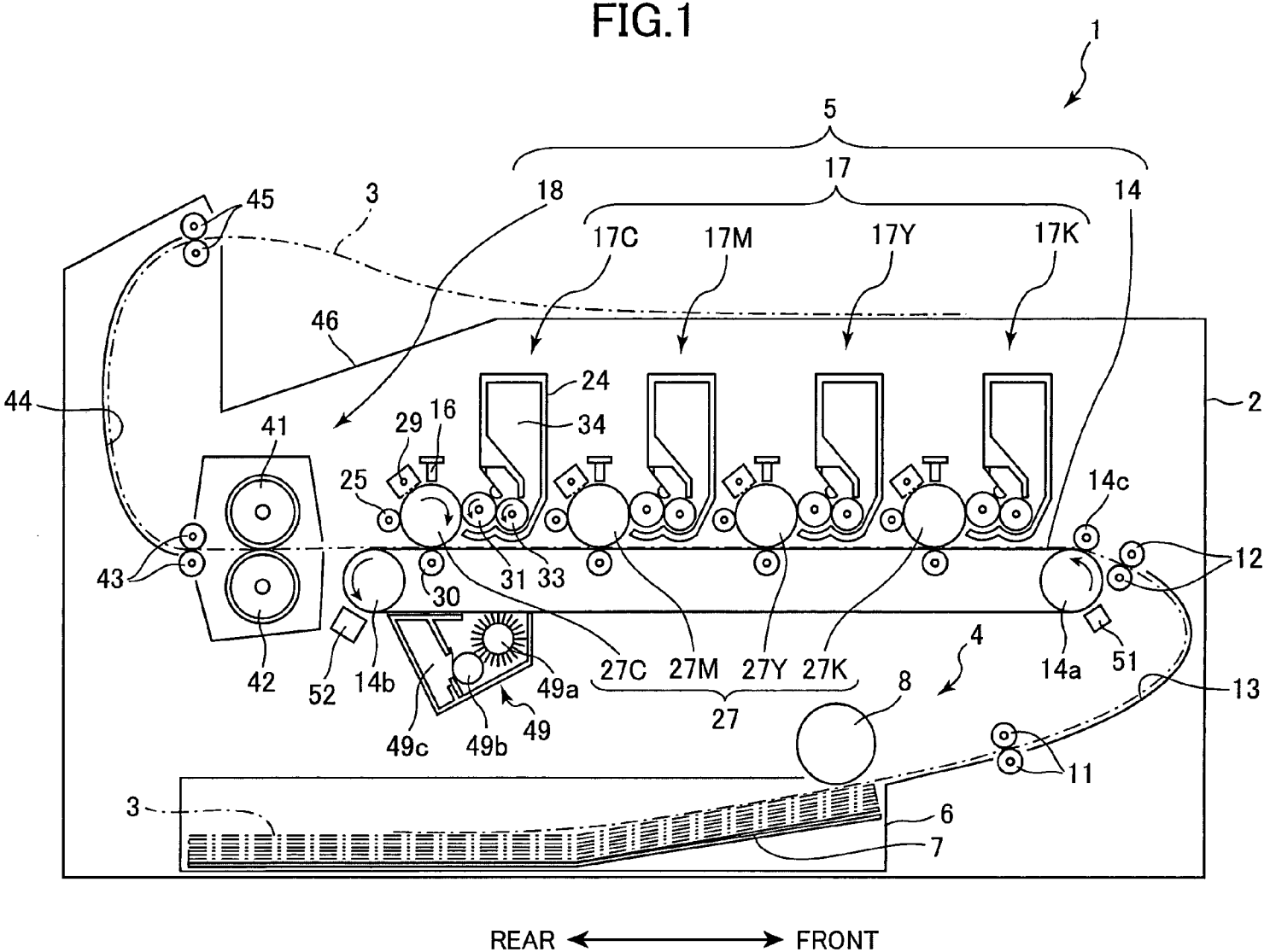
FIG. 1 is a side cross-sectional view showing an overall structure of a color printer according to an embodiment of the present invention.
Figure 2:
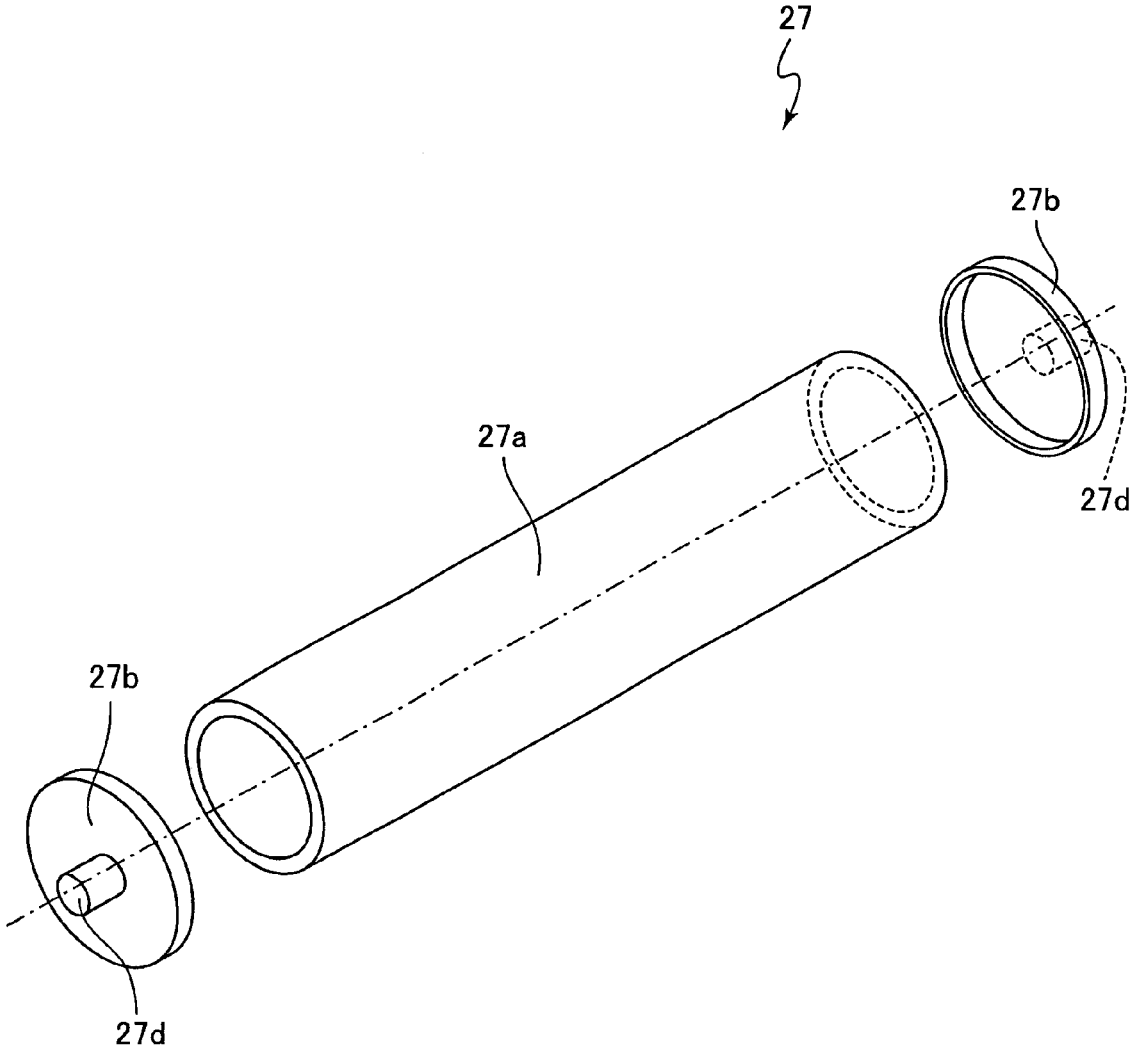
FIG. 2 is a perspective view showing a photosensitive drum of the color printer.

First, an overall structure of a color printer 1 will be described with reference to FIGS. 1 and 2. FIG. 1 is a side cross-sectional view showing the general structure of the color printer 1. FIG. 2 is an exploded perspective view showing a photosensitive drum 27 employed in the color printer 1.

As shown in FIG. 1, the color printer 1 includes a feeder unit 4 for supplying sheets of a paper 3, an image forming unit 5 for forming color images on the supplied sheets of the paper 3, a main casing 2 accommodating the feeder unit 4 and the image forming unit 5, and the like. The right side of the color printer 1 in FIG. 1 will be treated as the front surface of the device.

A discharge tray 46 is formed as a depression in the top of the main casing 2 from the rear side to the front side of the main casing 2, the slope of the depression lessening toward the front side, for maintaining printed sheets of the paper 3 in a stacked state. Further, the top surface of the main casing 2 can swing open for replacing developer cartridges disposed inside the color printer 1.

A paper discharge path 44 is provided in the rear of the main casing 2 (the left side in FIG. 1), forming an arc from top to bottom along the rear surface of the main casing 2. The paper discharge path 44 serves to guide the paper 3 discharged from a fixing unit 18 that is disposed in the lower rear section of the main casing 2 onto the discharge tray 46 provided on the top of the main casing 2. Discharge rollers 45 are provided near the end of the paper discharge path 44 in the conveying direction of the paper 3 for discharging the paper 3 onto the discharge tray 46.

The feeder unit 4 includes a feed roller 8 provided in the bottom section of the main casing 2; a feed cassette 6 detachably mounted in the same bottom section beneath the feed roller 8: a paper pressing plate 7 disposed in the feed cassette 6 for holding the stacked paper 3 and for pressing the paper 3 into contact with the feed roller 8; a paper-feeding path 13 for guiding the paper 3 from the feed cassette 6 to the image forming unit 5; a pair of conveying rollers 11 disposed along the paper-feeding path 13 downstream of the feed roller 8 in the conveying direction of the paper 3 for conveying the paper 3; and a pair of registration rollers 12 disposed near the end of the paper-feeding path 13 in the conveying direction of the paper 3 for adjusting the timing at which the paper 3 is conveyed for printing. Sheets of the paper 3 can be stacked on the paper pressing plate 7. The paper pressing plate 7 is supported such that the end nearest the feed roller 8 is capable of moving up and down and is urged toward the feed roller 8 by a spring (not shown) disposed on the underside thereof.

The image forming unit 5 includes processing units 17, a fixing unit 18, and a conveying belt 14. The conveying belt 14 is a seamless belt formed of polycarbonate or the like and is looped around two pulleys 14*a* and 14*b*. The two pulleys 14*a* and 14*b* are disposed in the main casing 2 near the front and rear, respectively, such that their axes are parallel to each other and extend in the left-to-right direction of the main casing 2 (the direction orthogonal to the plane of the drawing). The conveying belt 14 runs in a direction following the rotations of the two pulleys 14*a* and 14*b*, indicated by arrows in the drawing. A sheet of the paper 3 supplied from the feeder unit 4 is carried of the top peripheral surface (the side opposing the processing units 17) of the conveying belt 14 and conveyed toward the rear of the main casing 2. An absorbent roller 14*c* is disposed above the pulley 14*a* such that the conveying belt 14 is interposed between the pulley 14*a* and the absorbent roller 14*c*. The absorbent roller 14*c* applies a charge to the paper 3 as the paper 3 is guided from the paper-feeding path 13 onto the conveying belt 14, causing the paper 3 to become electrostatically attracted to the top peripheral surface of the conveying belt 14.

A belt position sensor 51 is disposed in confrontation with the conveying belt 14 beneath the pulley 14*a* for detecting a relative position on the peripheral surface of the conveying belt 14 in relation to the image forming unit 5. The belt position sensor 51 is configured of a photosensor including a light-emitting unit for irradiating light toward the object and a light-receiving unit for receiving light reflected off the object. A reference-position pattern is formed at a position near one widthwise edge of the conveying belt 14. The reference-position pattern has higher reflectance than the conveying belt 14 itself. Light emitted from the belt position sensor 51 reflects at a strong intensity from the position of the reference-position pattern and at a weak intensity from positions outside the reference-position pattern, enabling the belt position sensor 51 to detect the reference-position pattern. Since the rotational speed of the conveying belt 14 is known from previous experiments and the like, it is possible to detect a relative position of any given position on the conveying belt 14 by using the reference-position pattern as a reference position and measuring the amount of time elapsed since the belt position sensor 51 detected the reference-position pattern.

Alternatively, a hole may be formed in the conveying belt 14 in place of the reference-position pattern, and a light-emitting unit and light-detecting unit may be disposed one inside the conveying belt 14 and one outside, opposing each other across the conveying belt 14. In this case, light emitted from the light-emitting unit is detected by the light-detecting unit when the hole is interposed therebetween, while the light is blocked by the conveying belt 14 when the hole is positioned elsewhere. Accordingly, any given position on the conveying belt 14 can be determined at any time using the method described above. It is also possible to provide a plurality of the patterns or holes along an edge of the conveying belt 14. In this case, it is desirable to form one pattern or hole at a different shape or size than the others in order to distinguish this pattern or hole as the reference position.

The belt position sensor 51 also detects deviations of the conveying belt 14 in a widthwise direction (direction perpendicular to the sheet of drawing) according to a method well known in the art that uses two photosensors and a hole or printed pattern having a special shape. A belt guide (not shown) corrects any such deviation in the widthwise direction so that the conveying belt 14 rotates in a predetermined position at all times.

The processing units 17 (which is used as a collective term for processing units 17C, 17M, 17Y, and 17K) are arranged in a series along the conveying direction of the paper 3 above the conveying belt 14. Each processing unit 17 has the same construction and forms a monochromatic image on the paper 3 using toner of the corresponding color cyan, magenta, yellow, or black, while the paper 3 is electrostatically attracted to the conveying belt 14 and being conveyed between the two pulleys 14*a* and 14*b*. The following description of the processing units 17 refers to the processing unit 17C. Descriptions of the processing unit 17M, processing unit 17Y, and processing unit 17K have been omitted since their constructions are identical to that of the processing unit 17C.

Each processing unit 17 includes a developer cartridge 24 that includes a developing roller 31, a supplying roller 33, and a toner hopper 34 and is detachably mounted in the color printer 1; a photosensitive drum 27, which is a collective name for the photosensitive drums 27C, 27M, 27Y, and 27K; a Scorotron charger 29; a transfer roller 30; a cleaning roller 25; and an LED (Light Emitting Diode) unit 16.

The photosensitive drum 27 is capable of rotating in the direction indicated by the arrow (clockwise in FIG. 1) while in contact with the developing roller 31. As show in FIG. 2, the photosensitive drum 27 includes a main drum body 27*a* that is hollow and cylindrical in shape, and two drum support units 27*b* covering the ends of the main drum body 27*a*. Support shafts 27*d* protrude from the approximate centers of the drum support units 27*b* for rotatably supporting the photosensitive drum 27. The main drum body 27*a* includes a conductive base material formed in a cylindrical shape, the outer surface of which is coated with a positively-charged organic photosensitive material. The positively-charged photosensitive material includes a charge-generating material dispersed in a charge-transporting layer.

When the photosensitive drum 27 is exposed to laser light, LED light, or the like, the charge-generating material generates a charge through light absorption. The charge is transported to the surface of the main drum body 27*a* and the conducting material by the charge-transporting layer, thereby canceling the surface potential applied by the Scorotron charger 29. In this way, a difference in potential is created between areas exposed to light and areas not exposed to light. An electrostatic latent image is formed on the photosensitive drum 27 by exposing areas of the photosensitive drum 27 to laser light or LED light based on print data.

The Scorotron charger 29 shown in FIG. 1 is disposed above the photosensitive drum 27 and separated a predetermined distance therefrom so as not to contact the surface of the same. The Scorotron charger 29 has a charging wire formed of tungsten or the like from which a corona discharge is generated. Based on signals from a bias control unit 200 (FIG. 3), the Scorotron charger 29 applies a charge bias to charge the entire surface of the photosensitive drum 27 with a uniform positive polarity.

The surface of the photosensitive drum 27 is exposed by the LED unit 16, which emits light based on print data. The LED unit 16 includes a plurality of LEDs confronting the circumferential surface of the photosensitive drum 27 in an array extending along the axial direction of the same. The LED unit 16 is positioned downstream of the Scorotron charger 29 in relation to the rotational direction of the photosensitive drum 27 (clockwise in FIG. 1).

When the developer cartridge 24 is mounted in the image forming unit 5, the developing roller 31 is positioned downstream of the LED unit 16 in the rotational direction of the photosensitive drum 27 (clockwise in FIG. 1) and is capable of rotating in the direction indicated by the arrow (counterclockwise in FIG. 1), which is opposite the rotational direction of the photosensitive drum 27. The developing roller 31 includes a metal roller shaft covered by a roller formed of a conductive rubber material. The bias control unit 200 (see FIG. 3) applies a developer bias to the developing roller 31.

The supplying roller 33 is rotatably disposed on the side of the developing roller 31 opposite the photosensitive drum 27 and contacts the developing roller 31 while applying pressure to the same. The supplying roller 33 includes a metal roller shaft covered by a roller formed of a conductive foam material and functions to tribocharge toner supplied to the developing roller 31. The supplying roller 33 is capable of rotating in the direction indicated by the arrow (counterclockwise in FIG. 1), which is the same direction that the developing roller 31 rotates.

The toner hopper 34 is positioned to the side of the supplying roller 33 and is filled with developer supplied by the developing roller 31 via the supplying roller 33. The toner hoppers 34 in the processing units 17C, 17M, 17Y, and 17K are filled with toner of the corresponding color cyan, magenta, yellow, and black. In the present embodiment, the developer is a positively-charged nonmagnetic single-component toner. The developer is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1–C4) acrylate, or alkyl (C1–C4) meta acrylate. The polymerized toner is formed as particles substantially spherical in shape in order to have excellent fluidity. The toner is compounded with a coloring agent such as carbon black or wax, as well as an additive such as silica to improve fluidity. The diameter of the toner particles is about 6–10 μm. The processing units 17 for each color of toner may be arranged in any order with respect to the rotational direction of the conveying belt 14 and need not conform to the order described above.

The transfer roller 30 is provided below the photosensitive drum 27 and downstream of the developing roller 31 in the rotational direction of the photosensitive drum 27. The transfer roller 30 is supported so as to rotate in the direction of the arrow (counterclockwise in FIG. 1). The transfer roller 30 includes a metal roller shaft covered by a roller formed of an ion-conducting rubber material. During a transfer process, the bias control unit 200 (see FIG. 3) applies a transfer bias to the transfer roller 30. A transfer bias is a bias applied to the transfer roller 30 to generate a potential difference that causes toner electrostatically deposited on the surface of the photosensitive drum 27 to be electrically attracted toward the surface of the transfer roller 30.

The cleaning roller 25 is disposed downstream of the transfer roller 30 and upstream of the Scorotron charger 29 in relation to the rotational direction of the photosensitive drum 27. The bias control unit 200 (FIG. 3) applies a cleaning bias to the cleaning roller 25. During a printing process, the bias control unit 200 applies a forward cleaning bias to the cleaning roller 25 causing toner that was not transferred and that remains on the surface of the photosensitive drum 27 to be electrically attracted to and recovered by the cleaning roller 25, thereby preventing such residual toner from adversely affecting the photosensitive drum 27 in the next rotation. After the printing process, the bias control unit 200 applies a reverse cleaning bias to the cleaning roller 25, causing the collected toner to return to the surface of the photosensitive drum 27 and subsequently to be recovered by the developing roller 31. This process employed by the color printer 1 is referred to as a cleanerless developing method.

The fixing unit 18 is disposed to the side of and downstream of the conveying belt 14. The fixing unit 18 includes a heat roller 41, a pressure roller 42 applying pressure to the heat roller 41, and a pair of conveying rollers 43 disposed downstream of the heat roller 41 and pressure roller 42. The heat roller 41 includes a hollow aluminum roller that is coated with a fluorocarbon resin and subjected to heat treatment. A halogen lamp (not shown) is disposed inside the hollow roller for heating the same. The pressure roller 42 is configured of a silicon rubber shaft having low hardness that is covered by a tube formed of fluorocarbon resin. The pressure roller 42 contacts the heat roller 41 by a spring (not shown) urging the shaft of the pressure roller 42 toward the heat roller 41. The toner that is transferred to the surface of the paper 3 in the processing units 17 is fixed to the paper 3 by heat as the paper 3 passes between the heat roller 41 and the pressure roller 42. Subsequently, the conveying rollers 43 convey the paper 3 along the paper discharge path 44.

A pattern scanning sensor 52 is disposed below the pulley 14*b* and opposing the conveying belt 14 for scanning a calibration pattern 250 (see FIG. 7) formed on the conveying belt 14 during a calibration process described later. Like the belt position sensor 51, the pattern scanning sensor 52 is also a photosensor. The pattern scanning sensor 52 irradiates light onto the calibration pattern 250 and detects light intensity by converting the intensity of reflected light to electric signals. By providing two photosensors for detecting the light intensity of light reflected off the calibration pattern 250, regular reflection and irregular reflection can be detected. Thus, it is possible to determine the density of the calibration pattern 250 as a conventional density sensor. That is, the density of the toner forming the calibration pattern 250 can be found based on the ratio of light intensities detected by the two photosensors.

A cleaning unit 49 is disposed downstream of the pattern scanning sensor 52 in the rotational direction of the conveying belt 14 and not far separated from the pattern scanning sensor 52 for cleaning the peripheral surface of the conveying belt 14. The cleaning unit 49 includes an electrostatic brush 49*a*, a secondary roller 49*b*, and a waste toner box 49*c*. A bias is applied to the electrostatic brush 49*a*, which electrically attracts toner deposited on the peripheral surface of the conveying belt 14. The toner is then transferred via the secondary roller 49*b* and collected in the waste toner box 49*c*.

Figure 3:
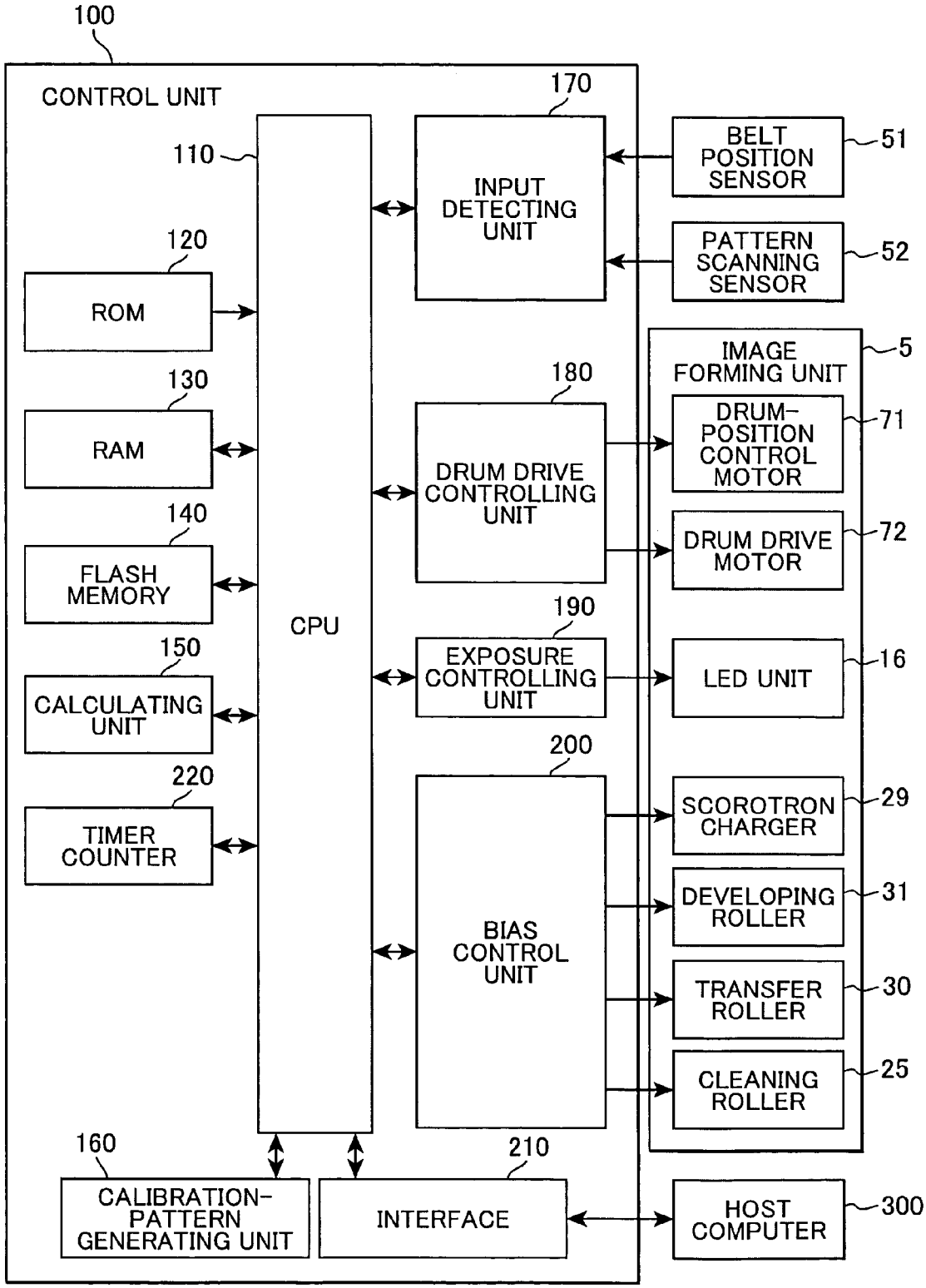
FIG. 3 is a block diagram showing an electrical configuration of the color printer.
Figure 4:
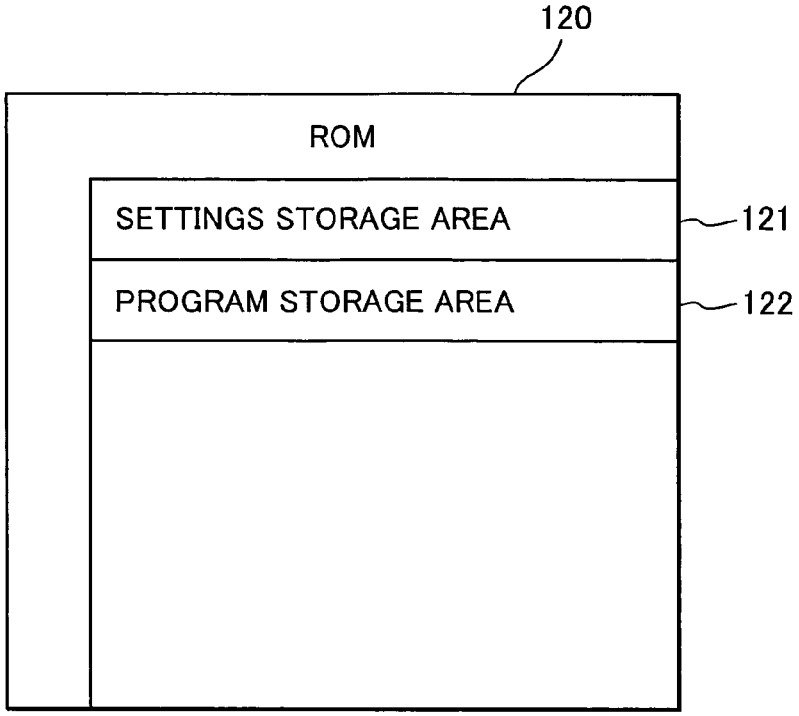
FIG. 4 is an explanatory diagram illustrating a storage area in a ROM.
Figure 5:
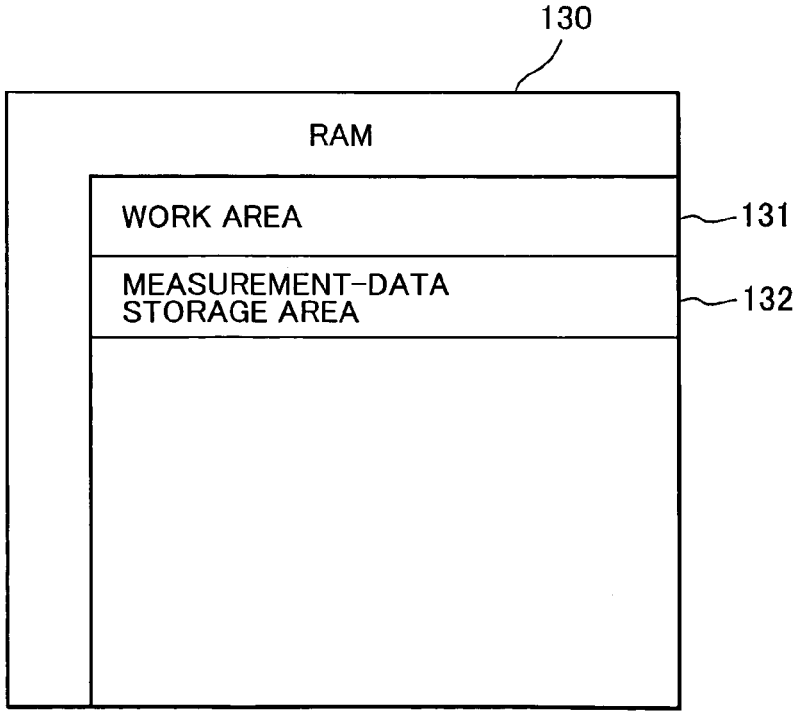
FIG. 5 is an explanatory diagram illustrating a storage area in a RAM.
Figure 6:
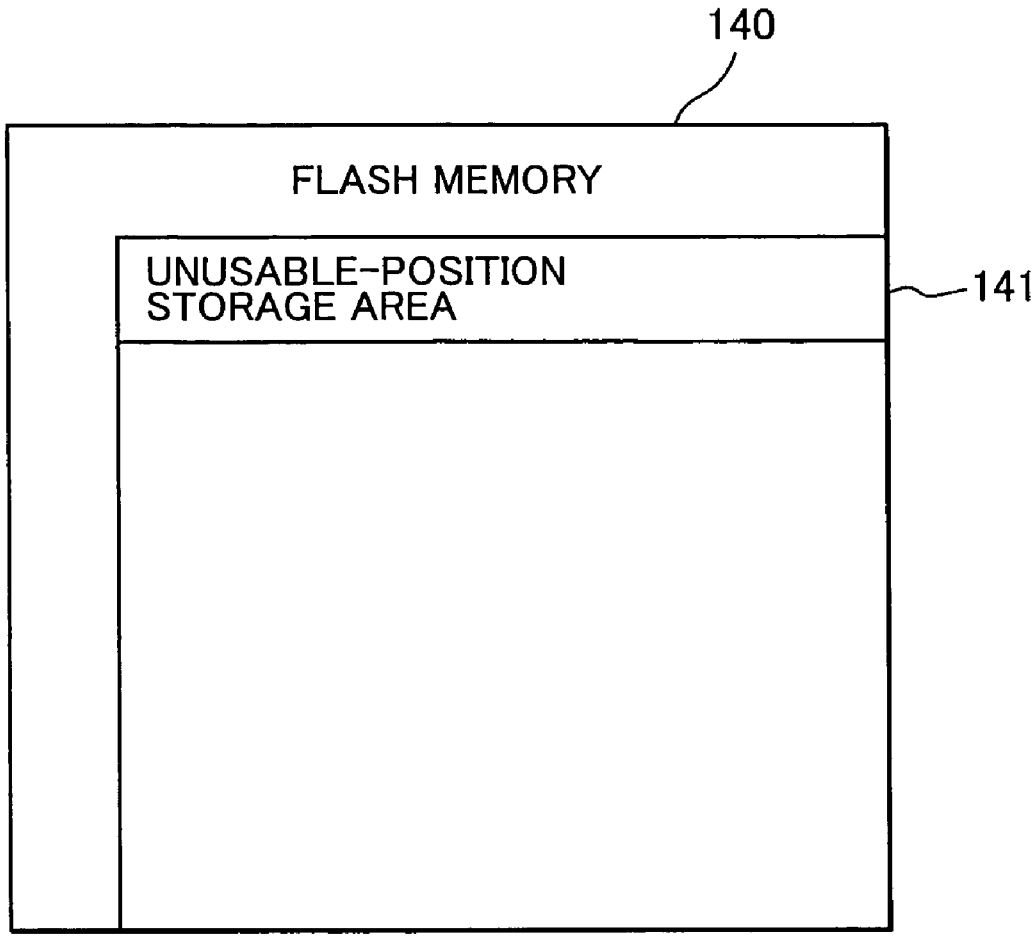
FIG. 6 is an explanatory diagram showing a storage area in a flash memory.

Next, the electrical configuration of the color printer 1 will be described with reference to FIGS. 3 through 6. FIG. 3 is a block diagram showing the electrical configuration of the color printer 1. FIG. 4 is an explanatory diagram showing the storage area in a ROM 120. FIG. 5 is an explanatory diagram showing the storage area in a RAM 130. FIG. 6 is an explanatory diagram showing the storage area in a flash memory 140.

As shown in FIG. 3, a control unit 100 for controlling the color printer 1 is provided with a CPU 110. The CPU 110 is connected to a ROM 120, a RAM 130, a flash memory 140, a calculating unit 150, a calibration-pattern generating unit 160, an input detecting unit 170, a drum drive controlling unit 180, an exposure controlling unit 190, a bias control unit 200, an interface 210, and a timer counter 220. The CPU 110 executes various programs and the like stored in the ROM 120, during which time the CPU 110 temporarily stores data on the RAM 130 and controls various components in the color printer 1.

The calculating unit 150 performs various computations required in the calibration process described later. The calibration-pattern generating unit 160 generates a calibration pattern 250 (see FIG. 7) that is formed in the image forming unit 5 and scanned by the pattern scanning sensor 52 during the calibration process.

The input detecting unit 170 is connected to the belt position sensor 51 and the pattern scanning sensor 52 and detects an object based on electric signals received from these sensors. A drum-position control motor 71 and drum drive motor 72 provided in each photosensitive drum 27 are connected to the drum drive controlling unit 180, which controls the driving of these motors. The drum-position control motors 71 function to move the shafts of the photosensitive drums 27 independently from one another in a horizontal front-to-rear direction along the conveying belt 14. The drum drive motors 72 function to rotate the photosensitive drums 27 independently.

The LED unit 16 is connected to the exposure controlling unit 190, which functions to turn each individual LED on and off based on print data. The bias control unit 200 is connected to the Scorotron charger 29, developing roller 31, transfer roller 30, cleaning roller 25, and the like described above and controls the biases that are applied to these components. A host computer 300 is connected to the interface 210. The interface 210 receives print data and the like transmitted from the host computer 300.

In the calibration process, the timer counter 220 counts the time from the beginning of an exposure process for forming the calibration pattern 250 until the pattern scanning sensor 52 detects this calibration pattern 250.

As shown in FIG. 4, the ROM 120 includes a settings storage area 121 for storing various settings, a program storage area 122 for storing various programs executed by the color printer 1, and the like.

As shown in FIG. 5, the RAM 130 includes a work area 131 for temporarily storing data when executing various programs and the like, a measurement-data storage area 132 for storing measurement data for the calibration pattern 250 read by the pattern scanning sensor 52, and the like.

The flash memory 140 shown in FIG. 6 is a non-volatile storage unit provided for keeping data after the power to the color printer 1 has been turned off. The flash memory 140 includes an unusable-position storage area 141 storing positional data for positions on the peripheral surface of the conveying belt that produce irregular or abnormal measurement data for the calibration pattern 250.

Next, operations of the color printer 1 performed during a printing process will be described with reference to FIGS. 1 and 3. When a printing process begins based on print data received from the host computer 300, the sheets of the paper 3 are separated one sheet at a time by a separating pad (not shown) and conveyed by the frictional force of the rotating feed roller 8. The conveying rollers 11 convey the paper 3 along the paper-feeding path 13 to the registration rollers 12. After registering the paper 3, the registration rollers 12 convey the paper 3 at a timing such that the leading edge of the visible image formed on the surface of the rotating photosensitive drum 27 matches the leading edge of the paper 3. The paper 3 conveyed by the registration rollers 12 becomes interposed between the absorbent roller 14*c* and the conveying belt 14 and is electrostatically attracted to the surface of the conveying belt 14 due to the charged absorbent roller 14*c*. As the paper 3 is conveyed on the conveying belt 14, the surface of the paper 3 opposing the four photosensitive drums 27 passes in sequence the photosensitive drum 27K, photosensitive drum 27Y, photosensitive drum 27M, and photosensitive drum 27C.

In the meantime, the bias control unit 200 applies a charge bias to the Scorotron charger 29, which charges the surface of the photosensitive drum 27 in each processing unit 17 to a potential of about 1000V. The LED unit 16 emits lights based on drive signals generated in the exposure controlling unit 190. The surface of the photosensitive drum 27 rotating in the direction of the arrow (clockwise in FIG. 1) is exposed to the LED light. The LED unit 16 emits light along the width of the paper 3 (direction perpendicular to the conveying direction of the paper 3) such that parts to be developed are exposed while parts not to be developed are not exposed. The surface potential at parts on the surface of the photosensitive drum 27 exposed to the LED light (bright areas) drops to about 200V. The LED light is irradiated in the conveying direction of the paper 3 as the photosensitive drum 27 rotates. The portions of the photosensitive drum 27 not irradiated by laser lights (dark areas) and the bright areas form invisible electrical images, that is, latent images.

Toner accommodated in the toner hopper 34 is supplied to the developing roller 31 by the rotation of the supplying roller 33. At this time, the toner is positively tribocharged between the supplying roller 33 and the developing roller 31. The toner carried on the developing roller 31 is adjusted to a uniform thin layer. A positive developing bias of about 400V is applied to the developing roller 31. As the developing roller 31 rotates, the positively-charged toner carried on the surface of the developing roller 31 comes into contact with the photosensitive drum 27 and is transferred to the electrostatic latent image formed on the surface thereof. That is, since the potential of the developing roller 31 is lower than the potential at a dark area (+1000V) and higher than the potential at a bright area (+200V), the toner is selectively transferred to bright areas having the lower potential. In this way, a developing process is performed to form a visible toner image on the surface of the photosensitive drum 27.

As the conveying belt 14 rotates and the paper 3 electrostatically attracted to the conveying belt 14 passes between the photosensitive drum 27 and the transfer roller 30, a transfer forward bias, which is a constant negative current with a voltage of about −1000V, that is lower than the potential in the bright areas (+200V) is applied to the transfer roller 30, transferring the visible image formed on the photosensitive drum 27 to the surface of the paper 3. In other words, the paper 3 passes by each processing unit 17 at a predetermined timing as monochromatic images in black, yellow, magenta, and cyan are sequentially transferred to the surface of the paper 3 and superimposed over the image formed by the processing unit 17 upstream in the conveying direction of the paper 3, thereby forming a multicolor image on the paper 3.

After toner of each color is transferred to the paper 3, an anti-static device (not shown) removes static electricity from the paper 3, enabling the paper 3 to separate from the conveying belt 14 and be conveyed to the fixing unit 18. The fixing unit 18 applies heat of about 200 degrees Celsius with the heat roller 41 and pressure with the pressure roller 42 to the paper 3 carrying the toner image, thereby forming a permanent image by fusing the toner into the surface of the paper 3. The heat roller 41 and the pressure roller 42 are grounded via diodes and configured such that the surface potential of the pressure roller 42 is lower than the surface potential of the heat roller 41. Accordingly, since positively-charged toner carried on the heat roller 41 side of the paper 3 is electrically attracted to the pressure roller 42 through the paper 3, image distortions during the fixing process that are caused by the toner being attracted the heat roller 41 are prevented.

After the toner is fixed on the paper 3 through heat and pressure, the paper 3 is conveyed along the paper discharge path 44 by the conveying rollers 43 and discharged onto the discharge tray 46 with the printed surface facing downward. Similarly, the next printed sheet of the paper 3 is stacked facing printed surface downward on top of the previously discharged sheet of paper 3. Accordingly, the user can obtain the sheets of paper 3 sorted in the order that they are printed.

As described above, the color printer 1 prints color images by superimposing monochromatic images formed in each color of toner on the paper 3. Therefore, if the mutual printing positions of the monochromatic images are even slightly out of alignment, the resulting color image will have errors in color registration. In order to prevent such registration errors, the color printer 1 performs a calibration process when the power is turned on, when a printing operation is not being performed, each time the number of sheets printed reaches a predetermined number, each time the length of operation time reaches a predetermined length, or the like.

There are three types of adjustments performed in the calibration process executed by the color printer 1 according to the present embodiment: (1) an adjustment in the print density of monochromatic images formed in each color of toner, (2) an adjustment of the relative alignment of each monochromatic image, and (3) an adjustment of phase shift caused by eccentricity in the rotational axis of the photosensitive drum 27.

Figure 7:
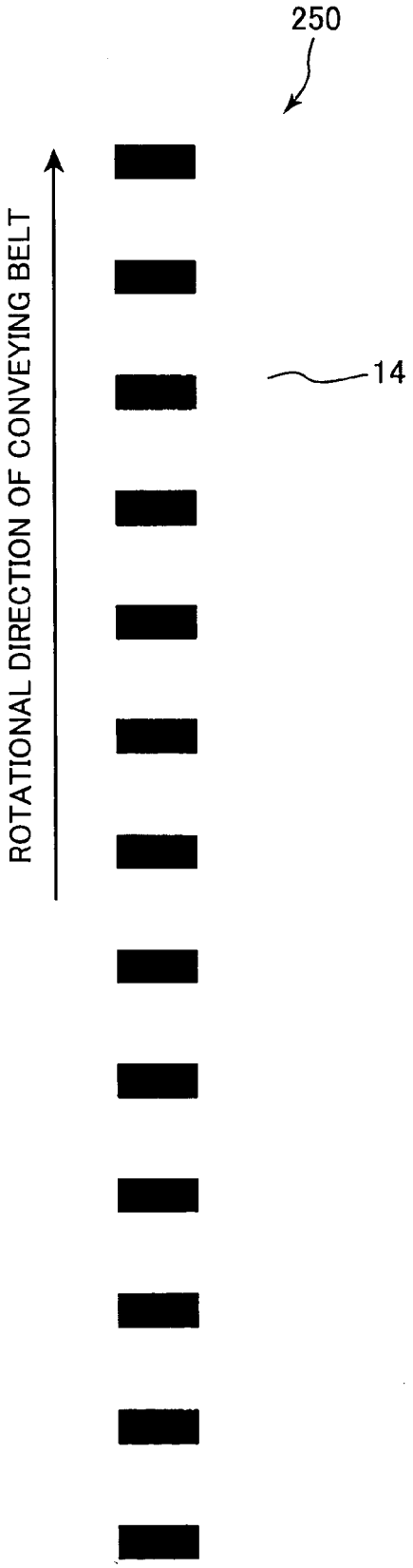
FIG. 7 is an explanatory diagram showing a sample calibration pattern formed on a peripheral surface of a conveying belt.

The adjustments in the calibration process will be described next with reference to FIGS. 7 through 13. The calibration pattern 250 shown in FIG. 7 is described below as one example of a pattern image. This monochromatic rectangular-shaped pattern image is formed on the conveying belt 14 at a predetermined timing by each of the processing units 17. However, the calibration pattern 250 is not limited to a rectangular shape.

Figure 8:
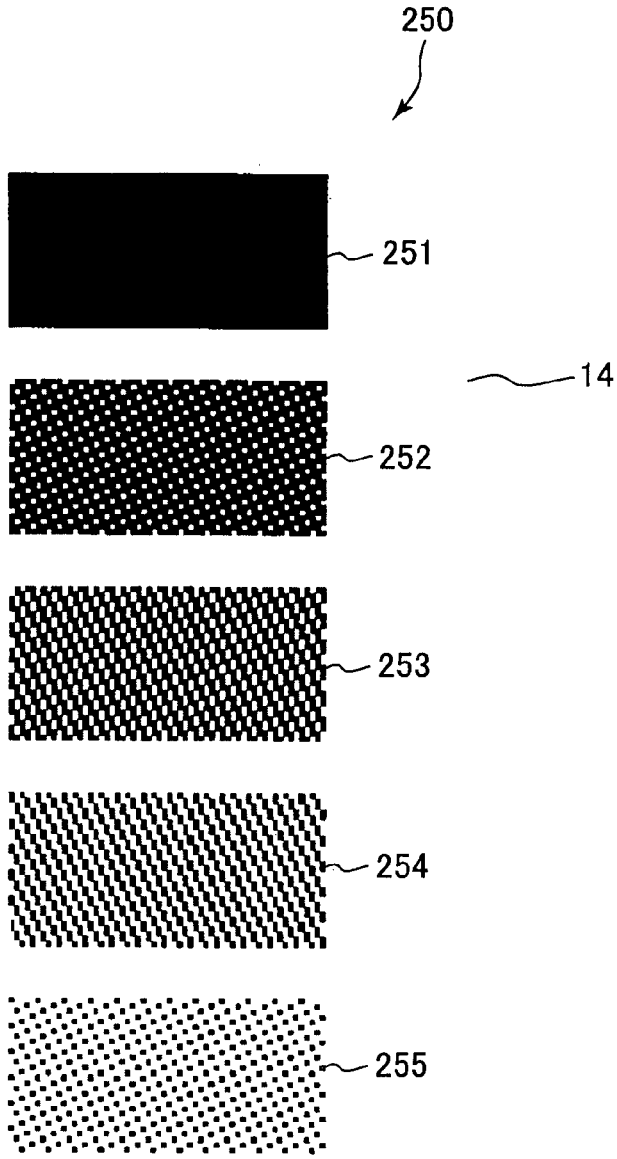
FIG. 8 is an explanatory diagram showing a sample calibration pattern for detecting printing density.

(1) The adjustment of toner density is performed for each color according to the same method in order to adjust the print density. As shown in FIG. 7, each of the processing units 17 forms the calibration pattern 250 on the peripheral surface of the conveying belt 14 at the predetermined timing. As shown in FIG. 8, the first five calibration patterns 250 may be formed as calibration patterns 251, 252, 253, 254, and 255 in which the culling rate of the pixels forming the image is divided into five stages of 0%, 20%, 40%, 60%, and 80%, respectively, for example. The pattern scanning sensor 52 scans each of the calibration patterns 251 through 255 to detect the density of each.

The densities of the calibration patterns 251 through 255 are compared to reference values found to be optimal densities in previous tests and the like (stored as settings in the settings storage area 121 of the ROM 120 shown in FIG. 4). The amount of toner used to form the calibration pattern 250 is determined to be too large if the density is greater than the reference value and too small if the density is less than the reference value. This density is adjusted by adjusting the developing bias applied to the developing roller 31, by adjusting the exposure time for exposing the photosensitive drum 27 to the LED unit 16, or the like in order to increase or decrease the amount of transferred toner. A table is stored in the settings storage area 121 of the ROM 120. The table has values that correlate amounts for adjusting the size of the developing bias or the length of the exposure time to detected densities and that are created based on tests and the like. Adjustments are made by referencing the values in this table.

(2) The mutual positions of the monochromatic images are adjusted by scanning the first (top) calibration pattern 250 shown in FIG. 7, for example. As described earlier, the rotational speed of the conveying belt 14 is known from experiments. Also, the position of each processing unit 17 in relation to the conveying belt 14 at any given time can be determined from the rotational speed of the conveying belt 14 and the amount of time elapsed since the belt position sensor 51 detects the reference-position pattern.

A position detection time is a detected length of time from the point the LED unit 16 begins irradiating light for forming the calibration pattern 250 until the pattern scanning sensor 52 detects the leading edge of the calibration pattern 250. A position reference time is a reference time that is determined from the position detection time that was detected in experiments and the like. The position reference time is stored in the settings storage area 121 of the ROM 120. Thus, it is possible to make adjustments based on a difference between the position detection time and the position reference time by counting the position detection time with the timer counter 220 during the calibration process.

Further, it is possible to identify the position of the calibration pattern 250 on the conveying belt 14 (a pattern forming position described later) by associating a timing at which the pattern scanning sensor 52 detects the leading edge of the calibration pattern 250 with a position on the conveying belt 14 that is determined from the amount of time elapsed since the belt position sensor 51 detects the reference-position pattern.

As described above, the relative offset between the pattern forming positions of each processing unit 17 can be found by identifying the positions of the calibration patterns 250 formed by each processing unit 17 on the conveying belt 14. The calibration pattern 250 for any one color is used as a reference. Because spatial offsets between the pattern forming positions of each processing unit 17 and the rotational speed of the conveying belt 14 are known, temporal offsets of the calibration patterns 250 between each processing unit 17 can be determined. Once the temporal offsets are determined, corrections can be performed by shifting the exposure timing of the LED unit 16 in each processing unit 17 by an amount equivalent to the corresponding temporal offset. For example, if the calibration pattern 250 formed in one of the processing units 17 lags behind the reference calibration pattern 250 in the conveying direction, exposure of the first calibration pattern 250 is initiated at a timing earlier by an amount equivalent to the temporal offset found from the spatial offset and the rotational speed of the conveying belt 14. If the spatial offset is forward in the conveying direction, then the exposure timing is delayed by an amount equivalent to the temporal offset found from the spatial offset and the rotational speed. In this way, the mutual positions at which each processing unit 17 forms monochromatic images can be adjusted.

In order to form a color image, the exposure timing by each LED unit 16 used to form each monochromatic image is synchronized between each processing unit 17. However, in some cases these timings are set constant or unchangeable in order to facilitate the control process for forming the image. In such cases, the drum-position control motor 71 is provided in each processing unit 17 for moving the position of the processing unit 17. Accordingly, the relative position of each monochromatic image can be adjusted by independently moving the shafts of the photosensitive drums 27 forward or rearward horizontally along the conveying belt 14. The drum-position control motor 71 is preferably a step motor or the like capable of performing fine adjustments in drive amount.

In either case of adjusting exposure timing or adjusting the positions of the processing units 17, the exposure timing or position of one processing unit 17 may be fixed while adjusting the exposure timings or positions of the other processing units 17. For example, the exposure timing or the position of the processing unit 17K is fixed while adjusting the exposure timings or the positions of the other processing units 17C, 17M, and 17Y with regard to the processing unit 17K. Alternatively, it is also possible to adjust the exposure timing or the position of each processing unit 17 with regard to the other processing units 17. For example, the exposure timing or the position of the processing unit 17K is adjusted with regard to the processing unit 17Y, the exposure timing or the position of the processing unit 17Y is adjusted with regard to the processing unit 17M, and the exposure timing or the position of the processing unit 17M is adjusted with regard to the processing unit 17C.

(3) The following process is performed to adjust the phase shift of the photosensitive drums 27. As described above, the photosensitive drum 27 is provided with the main drum body 27*a* and the two drum support units 27*b* provided on both ends of the main drum body 27*a* (FIG. 2). When manufacturing the photosensitive drum 27, the main drum body 27*a* can be manufactured with excellent precision in cylindricality, concentricality, and circularity. However, it is difficult to manufacture the support shafts 27*d* of the drum support units 27*b* in perfect alignment with the axis of the main drum body 27*a*. While the support shafts 27*d* are designed to be perfectly concentric with the main drum body 27*a*, deviations in alignment are unavoidable.

Figure 9:
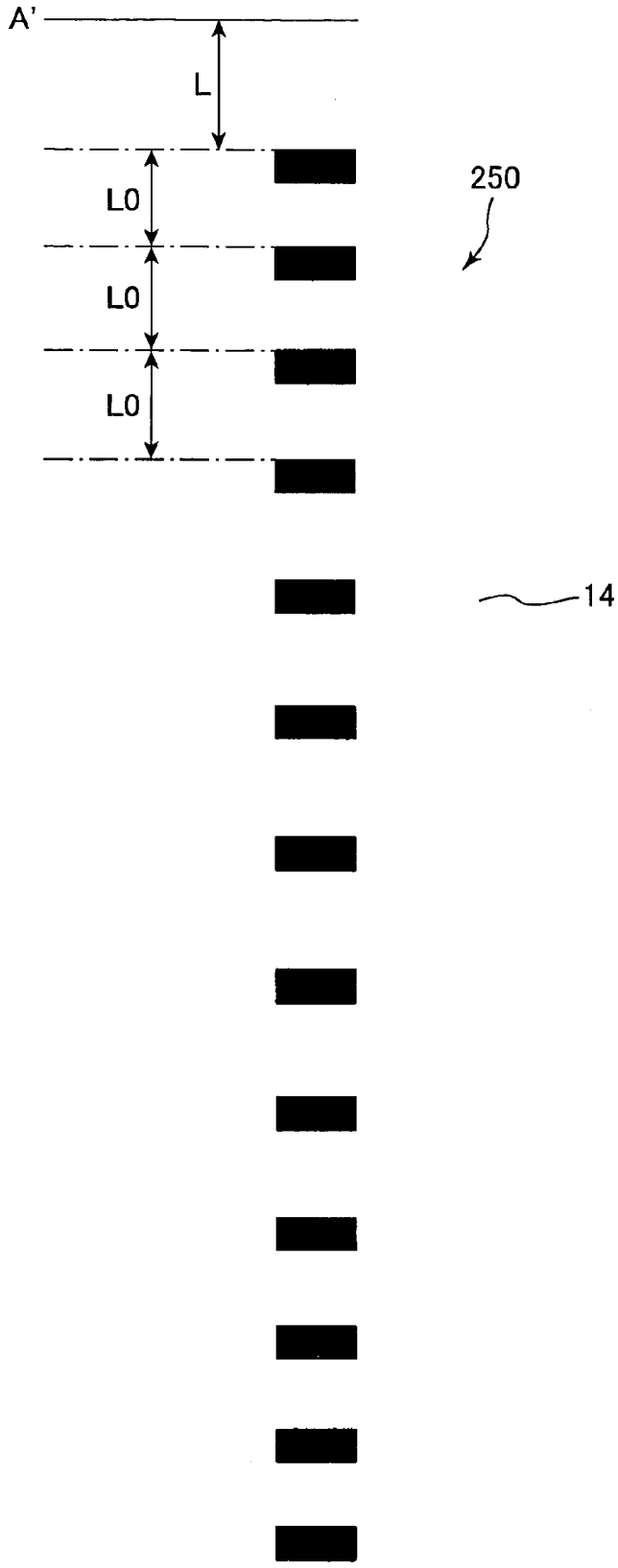
FIG. 9 is an explanatory diagram showing a sample calibration pattern formed on the peripheral surface of the conveying belt and showing the relationships between the calibration pattern and a reference point.

When forming the calibration pattern 250 on the peripheral surface of the conveying belt 14 using the photosensitive drum 27, the rotational speed of the photosensitive drum 27 is actually fixed or constant, as is the exposure timing of the LED unit 16. Accordingly, as shown in FIG. 9, if the photosensitive drum 27 is manufactured perfectly or ideally, the calibration patterns 250 formed on the conveying belt 14 are separated by a same length L0.

Figure 10:
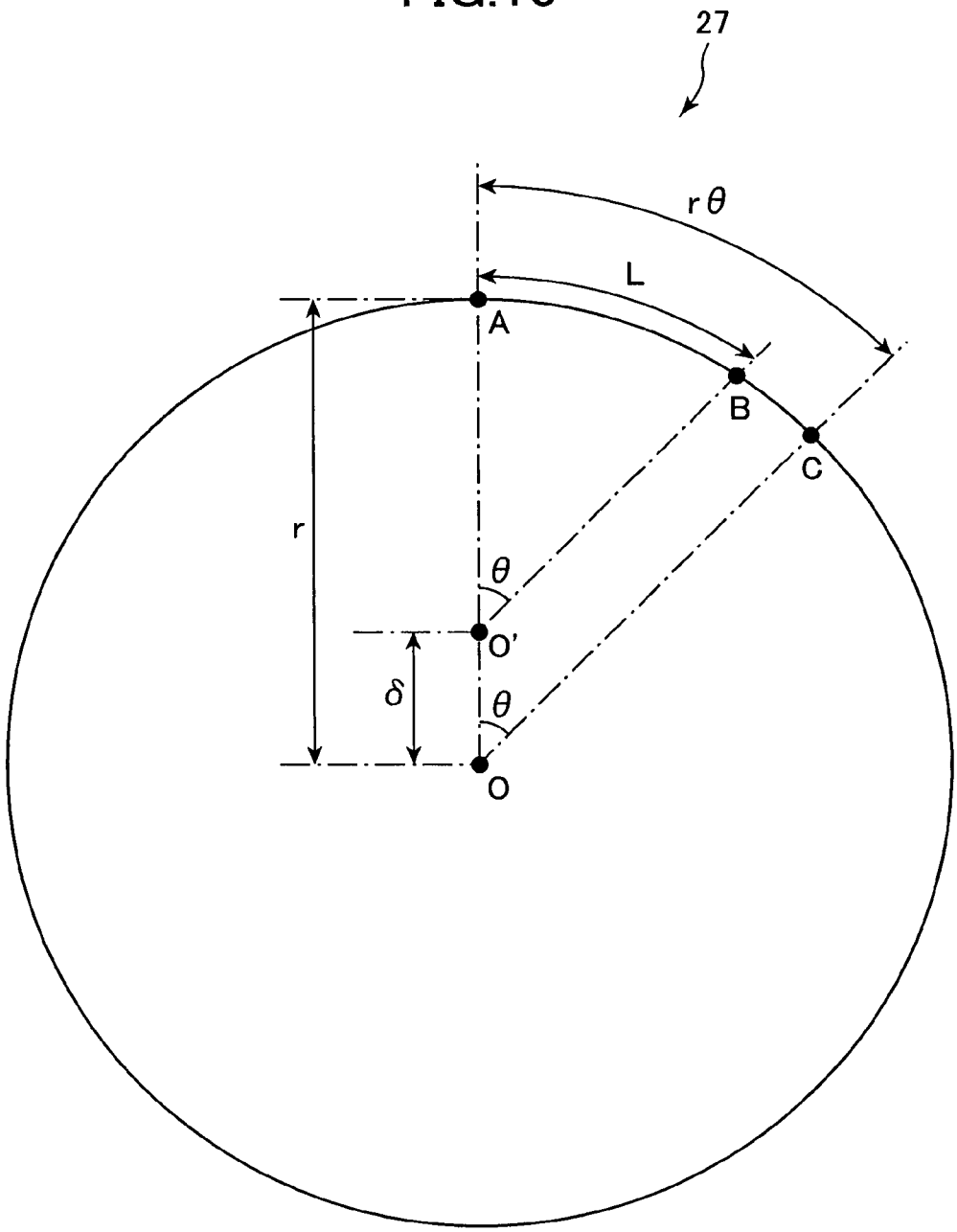
FIG. 10 is an explanatory diagram illustrating the eccentricity of a photosensitive drum in relation to its axis.

FIG. 10 illustrates the eccentricity of the photosensitive drum 27 in relation to its axis. As shown in FIG. 10, a point O denotes the central axis of the main drum body 27*a*, a length r denotes the radius of the main drum body 27*a*, a point O' denotes the center of the support shafts 27*d*, and a length δ denotes the offset from O to O'. If the rotational speed of the photosensitive drum 27 is ω (rad/sec) and exposure for forming the calibration patterns 250 is performed for t-second intervals, the rotational angle θ of the photosensitive drum 27 rotated for t seconds is represented by θ=ωt (rad). At this time, the photosensitive drum 27 rotates around O'; a reference point A on the surface of the drum reaches the position at a point B after t seconds; and a length L between the reference point A and the point B (that corresponds to a length between a reference point A' and a calibration pattern 250 in FIG. 9) is expressed by the following equation.

$$L=r[\theta-\sin^{-1}\{(\delta/r)\cdot\sin\theta\}]$$

The reference point A' is located at a position on the conveying belt 14 that corresponds to the reference point A on the photosensitive drum 27. Note that, if the photosensitive drum 27 rotates about the center O, the reference point A moves to a point C after t seconds, The distance between the reference point A and the point C is expressed by $2\pi r\times(\omega t/2\pi)=\theta$.

The function $f(x)=\sin^{-}x$ can be approximated as $f(x)=x$ when x is much smaller than 1. Since the deviation δ of the axis is designed to be extremely small as described above, the value of δ is much smaller than the drum radius r. Thus, a value δ/r is much smaller than 1. Accordingly, the length L is given by the following approximate equation.

$$L=r\{\theta-(\delta/r)\cdot\sin\theta\}=r\theta-\delta\ \sin\theta \qquad \text{(i)}$$

Next, the equation (i) will be applied to the present embodiment. If a value a is the axial deviation δ, a value b is the phase shift in the rotation of any two photosensitive drums 27, and a value c is the positional deviation of these two photosensitive drums 27, the following equation (ii) can be set from the equation (i).

$$L=r\theta-a\cdot\sin(\theta+b)+c \qquad \text{(ii)}$$

Since there are three unknown values (a, b, and c) in equation (ii), measurement data for at least three locations is necessary to find the values of a, b, and c. However, since measurement data commonly includes errors, it is preferable to take measurement data at a plurality of locations more than three in order to improve accuracy. The values for a, b, and c can be found based on the measurement data according to a calculation approach using the well-known least squares method. When the calculating unit 150 performs these calculations, we can obtain the graph of FIG. 11 showing the relationship between the rotational angle θ of any photosensitive drum 27, represented by the horizontal axis, and the length L on the surface of the photosensitive drum 27 between the reference point A and the point B (that is, the length L between the reference point A' and one of calibration patterns 250 in FIG. 9), represented by the vertical axis.

Figure 11:
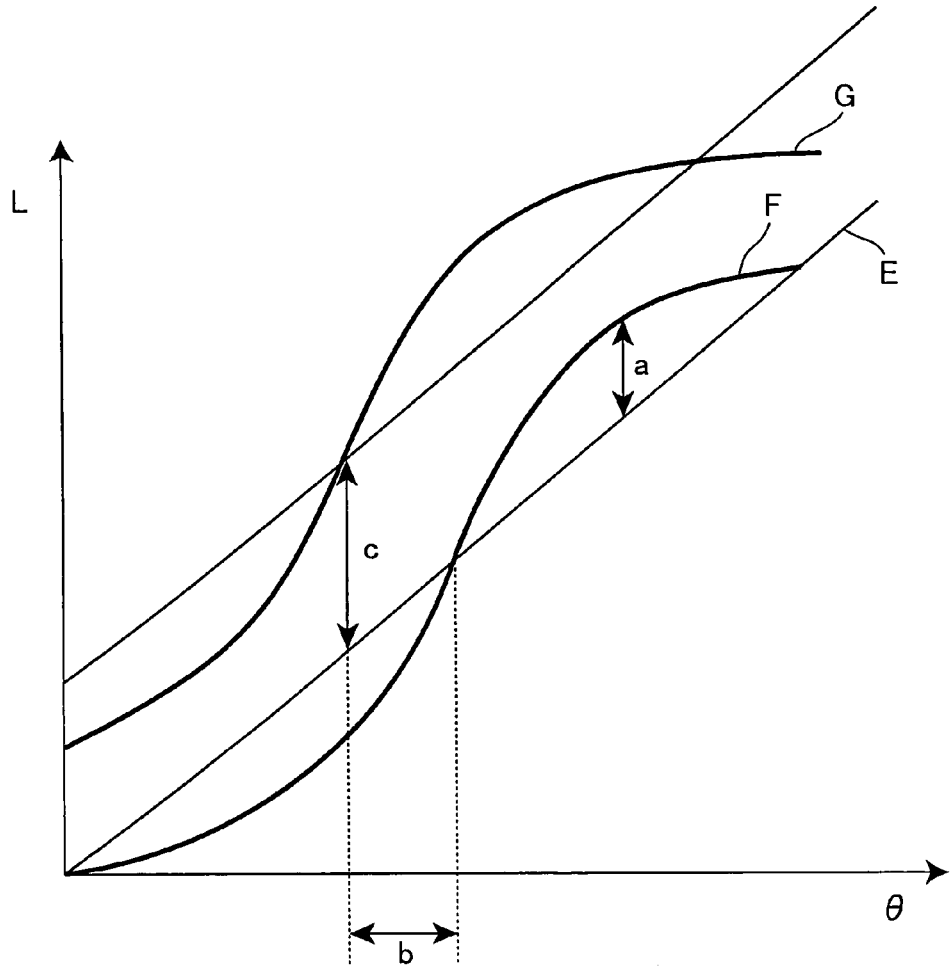
FIG. 11 is a graph showing the relationship between distance on the circumferential surface of the photosensitive drum and angle of rotation in order to illustrate color registration correction.

In the graph of FIG. 11, a curve F shows the relationship between the rotational angle e and length L of a reference photosensitive drum 27 (for example, the photosensitive drum 27K), while a curve G shows the relationship between the rotational angle θ and the length L of the photosensitive drum 27 (for example, the photosensitive drum 27C) being compared with the reference photosensitive drum 27. A line E shows the relationship when there is no axial deviation in the reference photosensitive drum 27. Since a, b, and c equal 0 at this time, the line E is a straight line (L=rθ). According to equation (ii) above, b and c equal 0 in the reference curve F (L=rθ−a·sin θ). Therefore, the curve F describes a sin curve having a vertical amplitude a about the line E.

The positional deviation c is a value affected by deviation in the distance between axes of the photosensitive drums 27 or by deviation in their exposure positions. Hence, c is the offset from the appropriate position (design position) for the horizontal (front-to-rear) position or exposure position of the processing units 17. In FIG. 11, when the curve G of the photosensitive drum 27 that is compared with the reference photosensitive drum 27 matches perfectly with the curve F of the reference photosensitive drum 27, a length L at any given rotational angle θ for the curves F and G are always equal, allowing no color registration errors to occur. The positional deviation c corresponds to the relative offset between the pattern forming positions of each processing unit 17 that is found in (2) described above. As described in (2), the positional deviation can be adjusted based on the value c either by shifting the exposure timing of the LED unit 16 in each processing unit 17 or by moving each photosensitive drum 27 forward or rearward. Note that, when the adjustment process described in (3) is performed, the adjustment process described in (2) may be omitted.

Figure 12A:
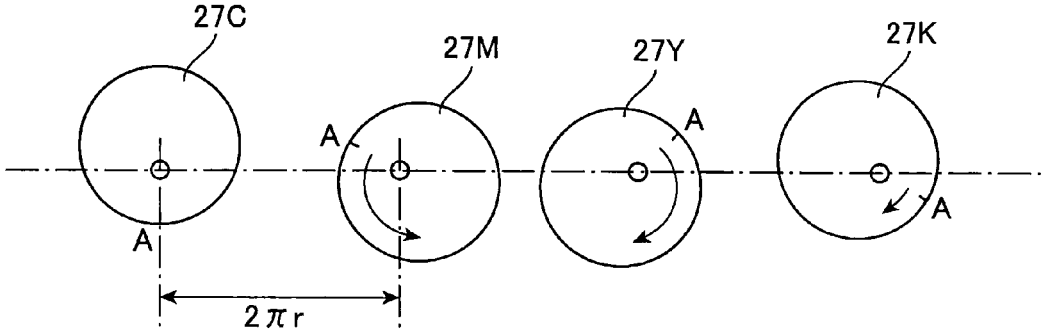
FIG. 12(*a*) is an explanatory diagram showing the state of photosensitive drums prior to adjusting a phase shift caused by the eccentricity of the photosensitive drums in relation to their axes.
Figure 12B:
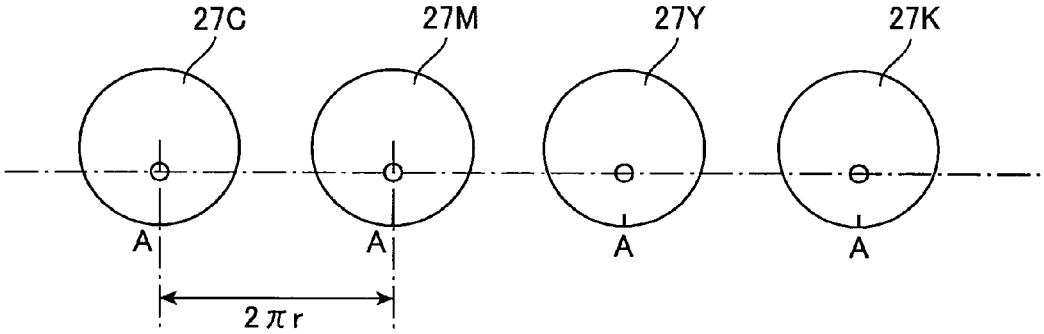

As shown in FIG. 12(*a*), the phase shift b is represented by the position of the reference point A on the circumferential surface of each photosensitive drum 27 (photosensitive drums 27C, 27M, 27Y, and 27K) at a specific timing, where the distance between axes of each photosensitive drum 27 is 2πr (or an integral multiple thereof). As shown in FIG. 12(*b*), the phase shift generated between the photosensitive drums 27 is adjusted by rotating each photosensitive drum 27 individually based on the phase shift b. The drum drive motors 72 (FIG. 3) drive the photosensitive drums 27 according to control by the drum drive controlling unit 180.

Alternatively, the phase shift b can be adjusted by controlling exposure timing at which each LED unit 16 exposes the circumferential surface of each photosensitive drum 27. As described earlier, corrections can be performed by shifting the exposure timing of the LED unit 16 in each processing unit 17 by an amount equivalent to the corresponding temporal offset that is obtained from the spatial offset.

Figure 13A:
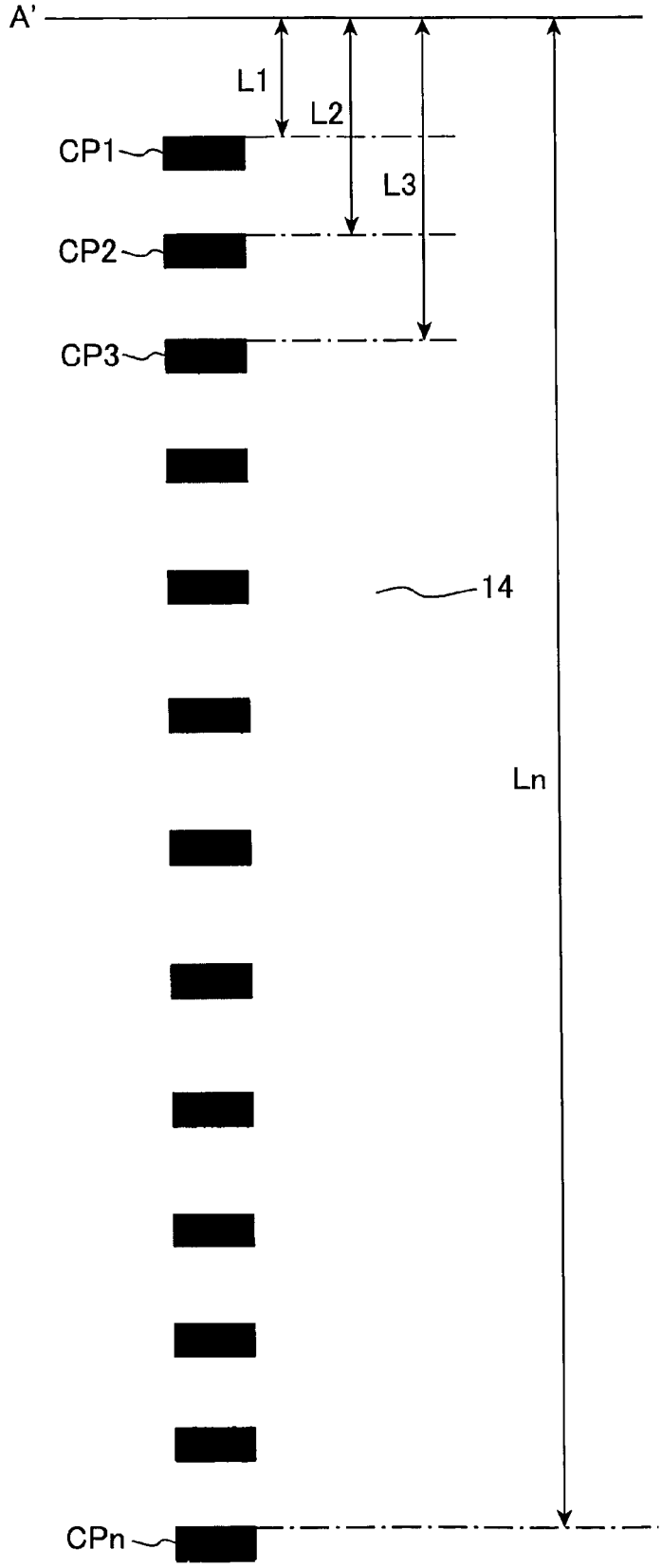
FIG. 13(*a*) is an explanatory diagram showing the calibration pattern in which a phase difference was generated due to eccentricity of the photosensitive drum and showing each length between the reference point and each calibration pattern on the conveying belt.
Figure 13B:
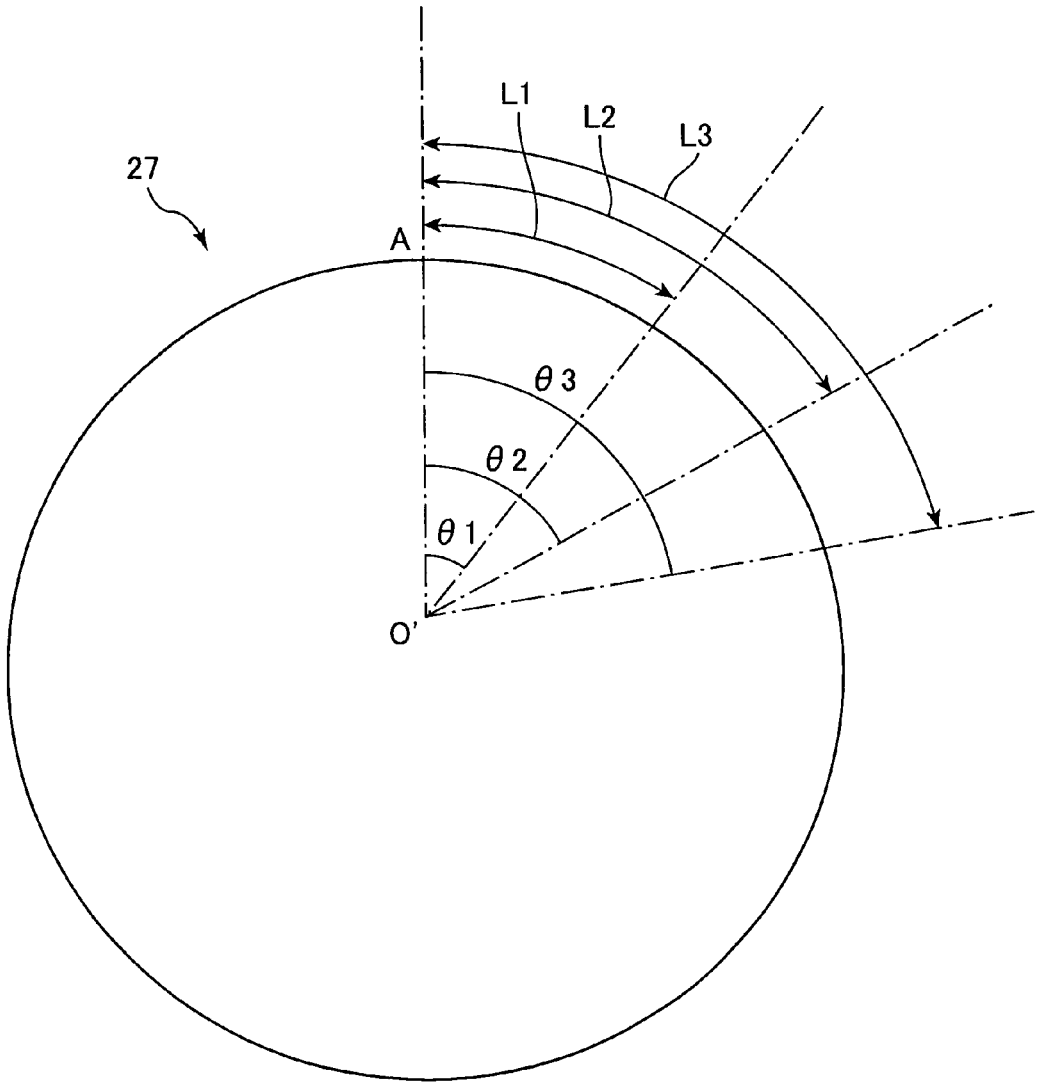

FIG. 13(*a*) shows the calibration pattern 250 more specifically. The reference point A' on the conveying belt 14 corresponds to the reference point A on the photosensitive drum 27. A first, second, third, . . . , and nth (n is a natural number) calibration pattern 250 is denoted as CP1, CP2, CP3, . . . , CPn. For example, a length L1 is a length between the reference point A' and a detected position of the first calibration pattern CP1, a length L2 is a length between the reference point A' and a detected position of the second calibration pattern CP2, and so on. FIG. 13(*b*) shows rotational angles θ1, θ2, θ3, . . . , of the photosensitive drum 27, each of which corresponds to each length L1, L2, L3, . . . . For example, a rotational angle θ1 is an angle between the reference point A and a point at which exposure is performed to form the first calibration pattern CP1, a rotational angle θ2 is an angle between the reference point A and a point at which exposure is performed to form the second calibration pattern CP2, and so on.

The measurement data can be expressed as pairs of the rotational angles and the lengths (θ1, L1), (θ2, L2), (θ3, L3), . . . , (θn, Ln) It is necessary to associate each length (L1, L2, L3, . . . , Ln) with each corresponding rotational angle (θ1, θ2, θ3, . . . , θn) to obtain the pairs (θ1, L1), (θ2, L2), (θ3, L3), . . . , (θn, Ln). Accordingly, intervals between the calibration patterns 250 (an interval between CP1 and CP2, an interval between CP2 and CP3, and so on) need to be at least twice the length of conceivable amount of a deviation of each calibration pattern (CP1, CP2, . . . , CPn) from its ideal or design position.

The above equation (ii) is set for each processing unit 17 as follows.

$$L=r\theta-a_k\cdot\sin\theta \tag{2k}$$

$$L=r\theta-a_c\cdot\sin(\theta+b_c)+c_c \tag{2c}$$

$$L=r\theta-a_m\cdot\sin(\theta+b_M)+c_M \tag{2m}$$

$$L=r\theta-a_Y\cdot\sin(\theta+b_Y)+c_Y \tag{2y}$$

The equations (2k), (2c), (2m), and (2y) are set for the processing unit 17K, 17C, 17M, and 17Y, respectively. In this example, the photosensitive drum 27K is used as the reference photosensitive drum 27. Thus, the equation (2k) corresponds to the curve F in FIG. 11. Similarly, the equation (2c), (2m), or (2y) corresponds to the curve G Unknown values $a_x$, ($a_c$, $b_c$, $c_c$), ($a_M$, $b_M$, $c_M$), ($a_Y$, $b_Y$, $c_Y$) can be obtained by detecting values of the rotational angles and lengths (θ, L) for each processing unit 17K, 17C, 17M, and 17Y, and by applying these values to the equation (2k), (2c), (2m), and (2y), respectively.

In FIG. 11, it is necessary that the curve G of the photosensitive drum 27C, 27M, or 27Y is shifted and matches the curve F of the reference photosensitive drum 27K in order to prevent color registration errors between the photosensitive drums 27. Hence, the following relationships need to be satisfied.

$$a_k=a_c=a_M=a_Y \tag{3a}$$

$$b_c=b_M=b_Y=0 \tag{3b}$$

$$c_c=c_M=c_Y=0 \tag{3c}$$

As described above, the positional deviation c is adjusted and eliminated, thereby satisfying the equation (3c). Likewise, the phase shift b is also adjusted and eliminated, thereby satisfying the equation (3b). In other words, the phase of each photosensitive drum 27 is adjusted to be identical with each other, as shown in FIG. 12(*b*). Although the axial deviation ($a_k$, $a_c$, $a_M$, $a_Y$) is not adjusted, color registration errors can be reduced by a considerable amount by adjusting the positional deviation c and the phase shift b.

In the present embodiment, the calculating unit 150 performs calculations to find values required for adjusting amounts for driving each motor and for adjusting the start timing of exposure. However, these values may be stored in a reference table that correlates each condition.

As described above, the color printer 1 performs calibration based on results from scanning the densities of the calibration patterns 250 formed on the peripheral surface of the conveying belt 14. However, if the peripheral surface of the conveying belt 14 suffers from wear due to extended use or abrasions caused by other circumstances (for example, abrasions generated by the occurrence or resolution of paper jams), the reflected direction of light irradiated on the calibration pattern 250 formed over such wear or abrasions can be influenced by the wear or abrasions, making it impossible to detect the density of the calibration pattern 250 with accuracy.

In order to achieve accurate calibrations, the color printer 1 of the present embodiment stores the positions on the peripheral surface of the conveying belt 14 at which abnormal measurement data were obtained. In subsequent calibrations, the color printer 1 does not incorporate measurements for calibration patterns 250 formed at positions determined to produce abnormal data.

Figure 14:
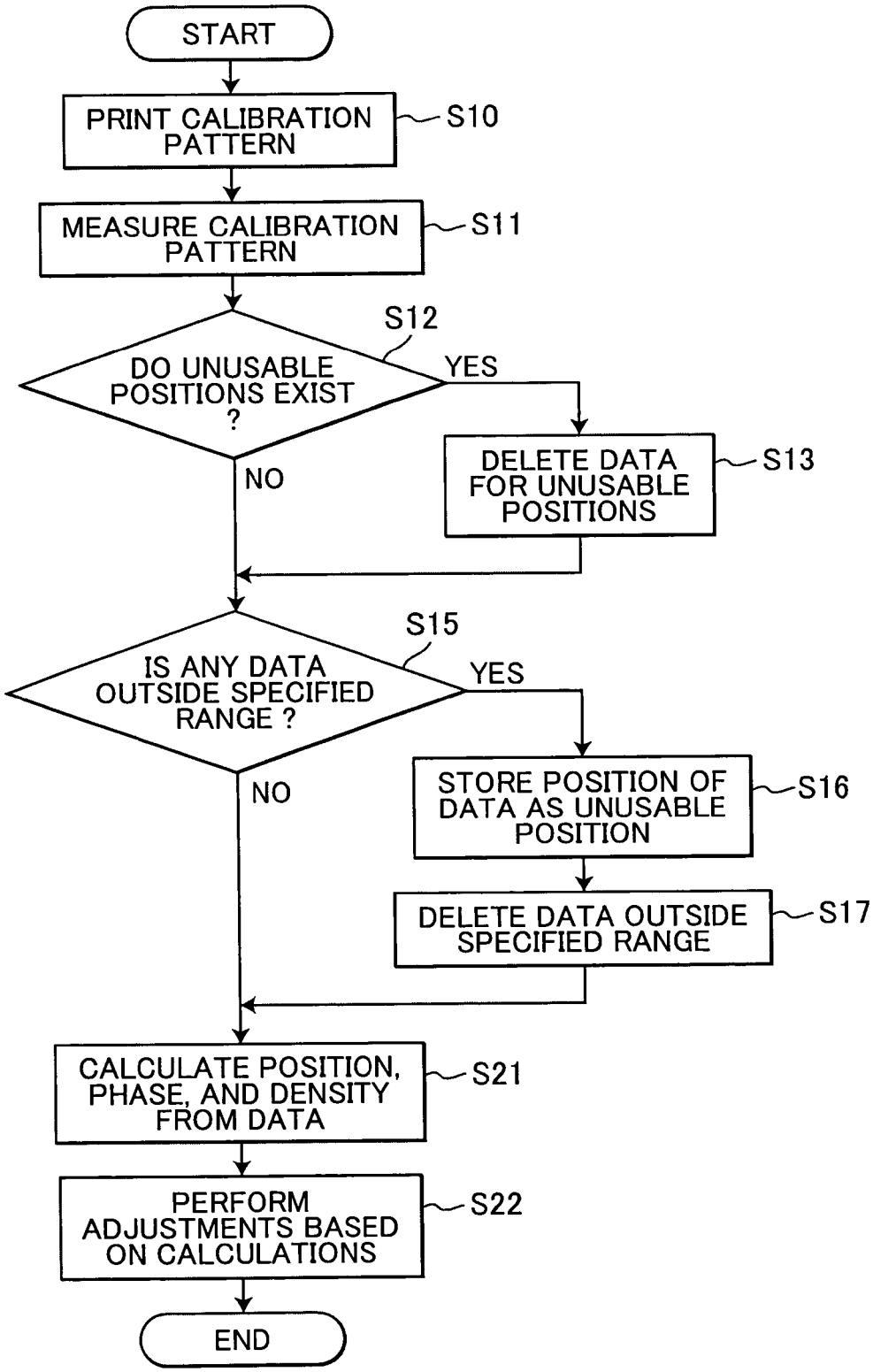
FIG. 14 is a flowchart showing the steps in a program for processing measured data for the calibration patterns according to the embodiment of the present invention.

Next, the treatment of measurement data for the calibration patterns 250 will be described with reference to FIG. 3 and FIG. 14. FIG. 14 is a flowchart showing the steps in a program for processing the measurement data. In the following description, the steps in the flowchart have been abbreviated as "S". The program is stored in the program storage area 122 of the ROM 120 and is read into the work area 131 of the RAM 130, and the CPU 120 executes the program to perform the calibration process.

When the color printer 1 performs the calibration process, the calibration-pattern generating unit 160 generates the calibration pattern 250 (FIG. 7) to be formed by each processing unit 17. Data for the calibration pattern 250 is transferred to the exposure controlling unit 190. In S10, the CPU 110 begins controlling the LED unit 16 in each processing unit 17 to irradiate light on the photosensitive drum 27, thereby printing the calibration pattern 250 on the peripheral surface of the conveying belt 14. At this time, the timer counter 220 begins counting elapsed time from the moment exposure began in each processing unit 17.

When the calibration pattern 250 reaches the position of the pattern scanning sensor 52 by the rotation of the conveying belt 14, the CPU 110 performs measurements in S11 on the calibration pattern 250 based on data scanned by the pattern scanning sensor 52. The measurement data includes count data from the timer counter 220 indicating the elapsed time from the moment the calibration pattern 250 was irradiated until the moment of detection by the pattern scanning sensor 52, data for the position of the calibration pattern 250 formed on the peripheral surface of the conveying belt 14 (the pattern forming position), and the density of the calibration pattern 250 detected by the pattern scanning sensor 52. The position of the calibration pattern 250 is determined based on time at which the pattern scanning sensor 52 detects the calibration pattern 250 (in other words, time counted by the timer counter 220 since the belt position sensor 51 detected the reference-position pattern on the conveying belt 14). Note that, if holes are formed on the conveying belt 14 in addition to the reference-position pattern, the position of the calibration pattern 250 is determined based on the number of holes counted since the reference-position pattern was detected. The measurement data is stored in the measurement-data storage area 132 in association with data indicating which processing unit 17 formed the calibration pattern 250 and the like.

Although the above-described adjustment process can be performed when each processing unit 17 forms at three calibration pattern 250, a more accurate calculation can be performed when the number of the calibration pattern 250 is higher. If one calibration pattern 250 is formed every several tens to several hundreds of pixels along the direction that the paper 3 is conveyed, sufficient measurement data can be obtained. Therefore, it is unnecessary to form the calibration pattern 250 over an entire cycle of the photosensitive drum 27. In the present embodiment, for example, the calibration pattern 250 is formed across a half-cycle worth of the circumferential surface on each photosensitive drum 27.

After all measurement data has been stored, in S12 the CPU 110 determines whether any unusable positions or abnormal positions exist by referencing the unusable-position storage area 141 in the flash memory 140. That is, the CPU 110 determines whether the pattern forming positions included in measurement data stored in the measurement-data storage area 132 match any positional data stored in the unusable-position storage area 141. Note that the positional data are stored in the unusable-position storage area 141 as unusable positions in the process of S16 described later.

If any of the pattern forming positions match positional data in the unusable-position storage area 141 (s12. YES), then in S13, the CPU 110 deletes, from the measurement-data storage area 132, all such pattern forming position data and all measurement data associated with the pattern forming positions, and advances to S15. However, if no pattern forming positions match the data in the unusable-position storage area 141 (S12: NO), then the CPU 110 advances directly to S15.

In S15, the CPU 110 determines whether any data is outside a specified range. The CPU 110 references all measurement data stored in the measurement-data storage area 132 and compares this data with data indicating an upper limit and a lower limit of a specified range that is stored in the settings storage area 121 of the ROM 120. One example of data indicating the upper limit and lower limit of the specified range is a maximum density and minimum density serving as limits to an allowable range found during previous tests and the like to ensure that the density of the calibration pattern 250 does not deviate too far from a reference density. Another example is a maximum position detection time and minimum position detection time serving as limits of an allowable range also found in previous tests or the like to ensure that the position detection time for each calibration pattern 250 does not deviate too far from the reference time. The CPU 110 compares each measurement data to the limits of the specified range and advances to S21 if the data falls within the specified range (S15: NO).

However, if measurement data does not fall within the specified range (S15: YES), then the measurement data is determined to be abnormal. In S16, the CPU 110 sets the position on the peripheral surface of the conveying belt 14 indicated by the pattern forming position of the measurement data as an unusable position or abnormal position, and stores the positional data in the unusable-position storage area 141 of the flash memory 140. In S17, the CPU 110 deletes all data associated with this measurement data from the measurement-data storage area 132 in the RAM 130.

When the CPU 110 advances to S21, all measurement data remaining in the measurement-data storage area 132 is normal, that is, within the specified range. Based on the measurement data, the calculating unit 150 calculates deviations between the density of each calibration pattern 250 and the reference density and deviations between the position detection times and the reference time. The CPU 110 then performs calculations or refers to the reference tables based on the above results in order to find adjustment amounts for the exposure timings of the LED units 16 required to correct alignment errors in the calibration patterns 250, drive amounts for the drum drive motors 72 required to correct phase shift, and application amounts of transfer bias and exposure time for the LED units 16 required to correct density. In S22, the CPU 110 completes the calibration process by adjusting each device based on the results of these calculations. The positional data stored in S16 as unusable positions is used in subsequent calibration processes as reference for the determination in S12.

As described above in the calibration process of the color printer 1, the pattern scanning sensor 52 scans the calibration pattern 250 formed on the peripheral surface of the conveying belt 14. When any of the measurement data is abnormal, the abnormal measurement data is not used for calibration. In other words, the abnormal measurement data is excluded from the data used for calibration. Accordingly, proper calibration can be performed using only normal measurement data. Further, the position on the peripheral surface of the conveying belt 14 at which the abnormal calibration pattern 250 was formed is stored as positional data so that measurement data for the calibration pattern 250 formed at that position in subsequent calibration processes are excluded. Accordingly, calibration can be performed effectively using proper measurement data. The unusable positions are stored as positional data in the flash memory 140, which can save the data when the power to the color printer 1 is turned off.

Therefore, as the peripheral surface of the conveying belt 14 wears down through extended use or incurs abrasions by other circumstances, it is not necessary to identify these positions each time a calibration process is performed, thereby shortening the time required for calibration. Further, since there are three unknown values in the calculations described above, it is sufficient to obtain measurement data for at least three positions in each color. Therefore, it is sufficient to rotate the conveying belt 14 until the calibration patterns 250 formed by the processing units 17K, which is farthest upstream in the rotational direction of the conveying belt 14, has been scanned by the pattern scanning sensor 52, thereby shortening the time required for calibration.

Further, positions at which measurement data for the calibration pattern 250 is abnormal due to abrasions and the like on the peripheral surface of the conveying belt 14 are detected based on reflected light acquired when scanning the calibration pattern 250. The positions of abrasions and the like on the peripheral surface of the conveying belt 14 are easily detected since differences in density are much clearer when scanning reflected light off a calibration pattern 250 formed in relatively bright cyan, magenta, or yellow toners, than when scanning reflected light off the conveying belt 14, which is normally black in color.

With the configuration of the color printer 1 described above, color registration errors can be corrected based on measurement data other than measurement data whose positional data are stored in the unusable-position storage area 141. Accordingly, the color printer 1 can begin correcting errors in color registration without searching for positions on the conveying belt 14 at which measurement data is abnormal or unusable, thereby shortening the time required for color registration correction.

When performing color registration correction, the color printer 1 can determine whether measurement data for the calibration pattern 250 is normal and can correct color registration based on the normal measurement data selected through this determination simply by measuring the calibration pattern 250 once with the pattern scanning sensor 52, thereby shortening the time required for color registration correction.

The color printer 1 can determine whether measurement data for the calibration pattern 250 is normal and can store the positional data of the calibration pattern 250 corresponding to the measurement data when the data is abnormal. Accordingly, the stored data may be used in subsequent color registration correction, thereby shortening the time required for color registration correction by simplifying the process.

Since the color printer 1 deletes measurement data whose positional data are stored in the unusable-position storage area 141, the color printer 1 can prevent color registration correction from being performed incorrectly based on abnormal measurement data.

Since density correction can be performed based on density data for the calibration pattern 250 formed on the conveying belt 14, a uniform image formation quality can be maintained, thereby allowing the pattern scanning sensor 52 to perform reliable detection.

The calibration pattern 250 may be formed across more than a half-cycle worth of the circumferential surface on each photosensitive drum 27. Accordingly, the color printer 1 can obtain a sufficient amount of measurement data required for color registration correction, allowing sufficiently accurate color registration correction.

Since color registration can be corrected on the conveying belt 14 on which a paper 3 is actually conveyed for forming images thereon, results of the correction can be accurately incorporated when forming images on the paper 3.

Further, since positions on the conveying belt 14 at which measurement data for calibration pattern 250 are abnormal are saved in the flash memory 140, the stored positions can be incorporated in subsequent color registration corrections even after the power to the color printer 1 is turned off.

While the invention has been described in detail with reference to specific embodiments thereof, it would be apparent to these skilled in the art that many modifications and variations may be made therein without departing from the spirit of the invention.

Figure 15:
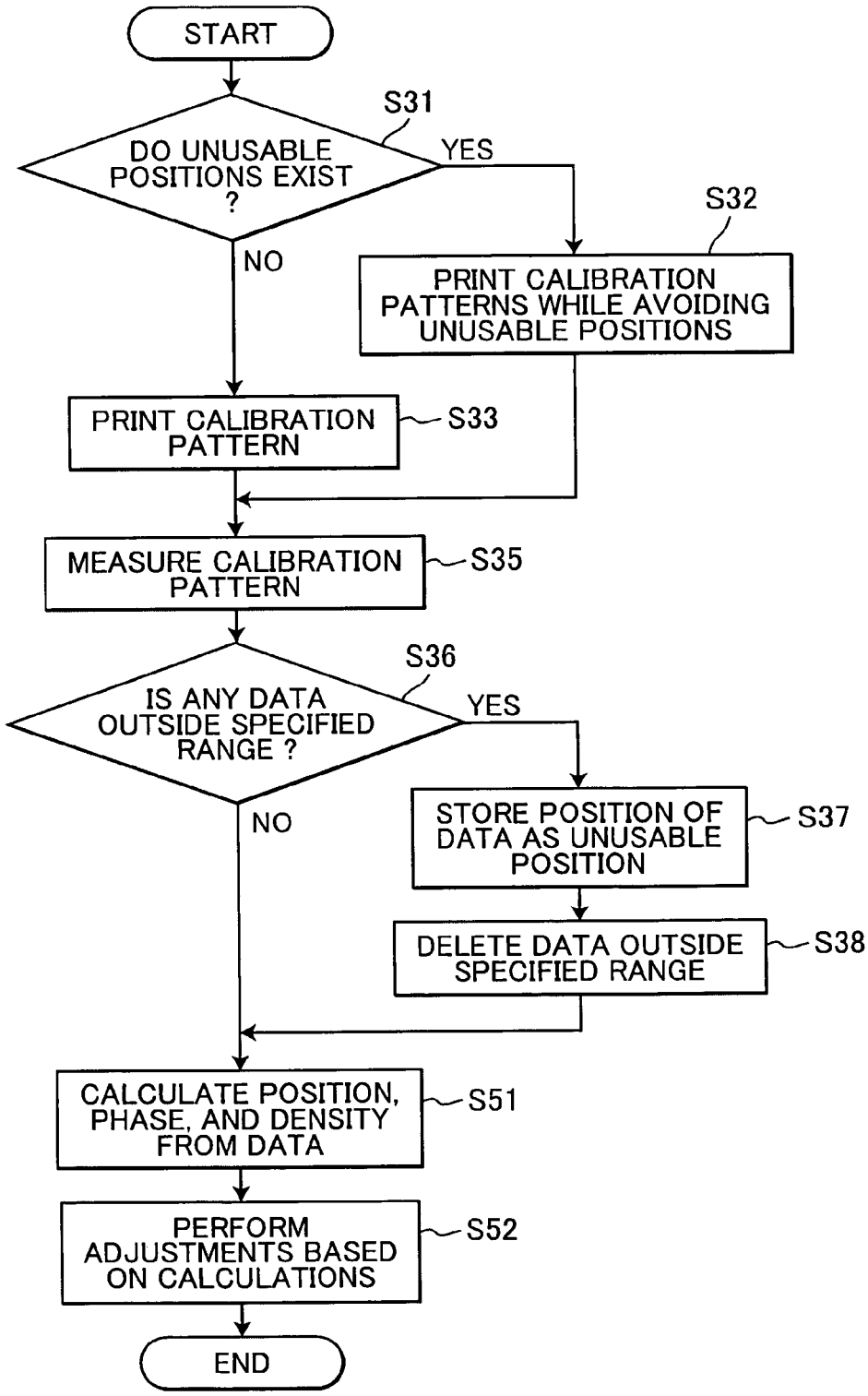
FIG. 15 is a flowchart showing the steps in a program for processing measured data for the calibration patterns according to a modification.

For example, in a calibration process shown in FIG. 15, the calibration pattern 250 is formed while avoiding a position on the peripheral surface of the conveying belt 14 that matches positional data stored in the unusable-position storage area 141.

At the beginning of the calibration process in this modification, the CPU 110 determines in S31 whether any unusable positions exist by referencing the unusable-position storage area 141 in the flash memory 140. If no positional data is stored in the unusable-position storage area 141 (S31: NO), then, as in the embodiment described above, the processing unit 17 for each color prints the calibration pattern 250 in S33. However, if unusable positions exist (S31: YES), then in S32 the CPU 110 controls the processing unit 17 to print the calibration pattern 250 while avoiding or skipping over those positions based on the detection results from the belt position sensor 51. In S35, the CPU 110 performs measurements on the calibration pattern 250 based on data scanned by the pattern scanning sensor 52. Hence, at this point measurement data no longer exists at positions determined to be abnormal in past calibrations.

The subsequent processes from S36 through S52 are identical to the processes of S15 through S22 of FIG. 14. In this way, the calibration process can be performed more quickly without the need to perform the process in S12 for all measurement data in order to determine whether the data coincides with a calibration pattern 250 formed in an unusable position. Further, it is possible to conserve toner by not forming the calibration pattern 250 that is already known to be unnecessary for calibration.

As described above, measurement data for at least three locations is sufficient for each processing unit 17. In Some cases, however, measurement data for at least three locations are not obtained after excluding some measurement data in unusable positions (S13 in FIG. 14) and excluding other measurement data as being out of the specified range (S17). In another modification shown in FIG. 16, an additional step S18 is provided for determining whether measurement data for at least three locations have been obtained. Adding the step S18 can prevent the occurrence of an error indicating that calculation is not possible due to insufficient number of data, If measurement data for three or more locations have been obtained (SIB: YES), the CPU 110 advances to the process of S21. If measurement data for at least three locations have not been obtained (S18: NO), the CPU 110 returns to S10'. In S10', the control unit 100 controls the processing unit 17 to form new calibration patterns 250 at positions different from the previous time. The positions to form the new calibration patterns 250 can be controlled by the detection results of the belt position sensor 51. For example, it is possible to store, in the work area 131 of the RAM 130, count values based on the belt position sensor 51 at the timing of beginning to print the calibration patterns 250 at the previous time. Then, new calibration patterns 250 can be printed while avoiding beginning to print calibration patterns 250 from these count values. In this way, the occurrence of errors can be reduced by not forming calibration patterns 250 in the same position as the previous time. Further, it is possible to avoid positions at which errors frequently occur by disposing a plurality of the pattern scanning sensors 52 along the widthwise direction of the paper and changing the widthwise (left-to-right) position for forming the calibration pattern 250.

Figure 16:
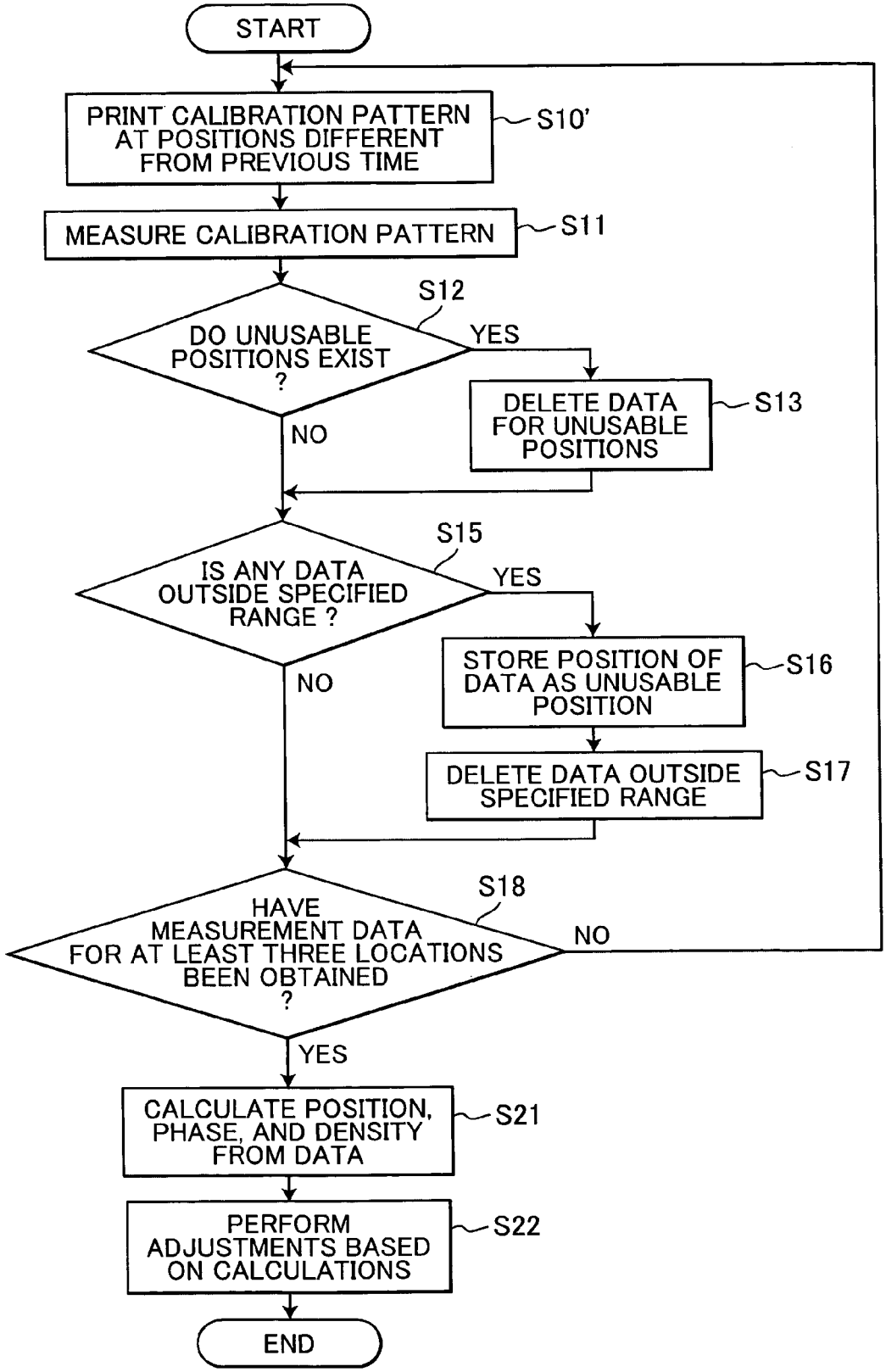
FIG. 16 is a flowchart showing the steps in a program for processing measured data for the calibration patterns according to another modification.

In the modification shown in FIG. 16, color registration correction is repeated, if measurement data was not obtained for at least three locations in the calibration pattern 250. Thus, the color printer 1 can avoid a situation in which color registration correction cannot be performed due to an insufficient number of measurement data.

In another modification, when storing positional data of unusable positions in the unusable-position storage area 141, the positional data may be stored in association with a counter. For example, the counter value is incremented by one each time the data is determined to be outside the specified range (S15: YES). When the value reaches three, this positional data can be determined as positional data of an unusable position. In this way, if a scanning abnormality occurs temporarily due to foreign matter adhering to the peripheral surface of the conveying belt 14 or the like, this position is not considered abnormal or unusable if the problem is resolved prior to the counter value reaching three.

By referring to the unusable-position storage area 141 when measuring the calibration pattern 250 in S11, it is possible to prevent the pattern scanning sensor 52 from scanning the calibration pattern 250 formed at pattern forming positions matching positional data stored therein. In other words, the calibration pattern 250 is scanned while referring to the unusable-position storage area 141. At this time, scanning of the calibration pattern 250 located at positions matching the stored positional data is not performed. Accordingly, it is possible to skip the process of S12 and advance directly to S15, thereby shortening the time required for calibration, when compared with simply scanning the calibration pattern 250 and removing measurement data for the calibration pattern 250 formed at abnormal positions.

In the embodiment described above, the color printer 1 employs the LED unit 16 to expose the photosensitive drum 27. However, the color printer 1 may be a laser printer that performs exposure with a laser unit capable of generating laser light. Further, while images are formed directly on the paper 3 by conveying the paper 3 on the conveying belt 14 in the above-described embodiment, color images may be formed temporarily on the conveying belt 14 and subsequently transferred to the paper 3 in an intermediate transfer method. In addition, the conveying belt 14 may be a drum-type member rather than a belt-type member.

What is claimed is:

1. An image forming device for forming a multicolor image by superimposing a plurality of monochromatic images on a recording medium, the device comprising:

an image carrying member carrying an image;

a plurality of image forming units, each of the plurality of image forming units forming a monochromatic calibration image on the image carrying member;

a measuring unit measuring at least one predetermined kind of information with respect to the monochromatic calibration image, thereby obtaining at least one data group of the at least one predetermined kind of information;

a measurement-data storing unit that stores the at least one data group;

an abnormal-data excluding unit excluding abnormal data from each of the at least one data group stored in the measurement-data storing unit, thereby obtaining normal data; and a color-registration correcting unit adjusting the plurality of image forming units based on the normal data, thereby correcting color registration errors among a plurality of monochromatic images.

2. The image forming device as claimed in claim 1, further comprising a position detecting unit detecting a reference position on the image carrying member and obtaining an image forming position of the monochromatic calibration image on the image carrying member, the image forming position being a relative position with regard to the reference position.

3. The image forming device as claimed in claim 2, wherein each of the at least one data group includes at least one data element, and wherein the abnormal-data excluding unit includes an abnormal-data determining unit determining whether each of the at least one data element is out of a predetermined range, thereby determining abnormal data.

4. The image forming device as claimed in claim 3, wherein the abnormal-data excluding unit further includes an abnormal-position determining unit determining, as an abnormal position, the image forming position of the monochromatic calibration image at which abnormal data has been obtained.

5. The image forming device as claimed in claim 4, wherein the abnormal-data excluding unit further includes an abnormal-position storing unit storing positional data of the abnormal position.

6. The image forming device as claimed in claim 5, wherein the each of the plurality of image forming units forms the monochromatic calibration image on the image carrying member, while avoiding the abnormal position whose positional data is stored in the abnormal-position storing unit.

7. The image forming device as claimed in claim 5, wherein the measuring unit measures the at least one predetermined kind of information for the monochromatic calibration image, while avoiding the abnormal position whose positional data is stored in the abnormal-position storing unit.

8. The image forming device as claimed in claim 5, wherein the measurement-data storing unit stores the at least one data element of the at least one data group; and wherein the abnormal-data excluding unit further includes an abnormal-data deleting unit deleting, from the at least one data element stored in the measurement-data storing unit, the abnormal data whose positional data is stored in the abnormal-position storing unit, thereby obtaining the normal data.

9. The image forming device as claimed in claim 8, wherein the abnormal-data deleting unit further deleting, from the at least one data element stored in the measurement-data storing unit, the abnormal data which has been determined to be out of the predetermined range by the abnormal-data determining unit.

10. The image forming device as claimed in claim 5, wherein the abnormal-position storing unit is a nonvolatile storage unit.

11. The image forming device as claimed in claim 3, wherein the each of the plurality of image forming units is provided for each of a plurality of colors;

wherein the color-registration correcting unit includes:

a calibration-image generating unit generating a plurality of monochromatic calibration images in each of the plurality of colors and controlling each of the plurality of image forming units to form the plurality of monochromatic calibration images at predetermined intervals; and a normal-data-number determining unit determining whether the abnormal-data excluding unit has obtained at least three normal data of the monochromatic calibration images, the at least three normal data having positional data that are not stored in the abnormal-position storing unit, the at least three normal data having been determined to be in the predetermined range by the abnormal-data determining unit; and wherein, if the normal-data-number determining unit has determined that a number of the normal data obtained by the abnormal-data excluding unit is less than three, the calibration-image generating unit controls each of the plurality of image forming units to form a plurality of monochromatic calibration images at different positions on the image carrying member, the different positions being different from positions at which the plurality of image forming units has already formed the plurality of monochromatic calibration images, thereby allowing the color-registration correcting unit to repeat correcting color registration errors.

12. The image forming device as claimed in claim 3, wherein the each of the plurality of image forming units is provided for each of a plurality of colors;

wherein the each of the plurality of image forming units includes an electrostatic-latent-image carrying member having a drum shape with a circumferential surface opposing the image carrying member, the electrostatic-latent-image carrying member carrying an electrostatic latent image formed on the circumferential surface and transferring, to the image carrying member, a developer image formed on the electrostatic latent image, thereby forming a monochromatic image on the image carrying member; and wherein the color-registration correcting unit includes:

a calibration-image generating unit generating a plurality of monochromatic calibration images in each of the plurality of colors and controlling each of the plurality of image forming units to form the plurality of monochromatic calibration images at predetermined intervals;

a phase determining unit determining a phase of each electrostatic- latent-image carrying member based on a position of each of the plurality of monochromatic calibration images on the image carrying member detected by the position detecting unit; and a phase control unit controlling each of the plurality of image forming units to correct the color registration errors caused by a difference between the phase of each electrostatic-latent-image carrying member.

13. The image forming device as claimed in claim 12, wherein the each of the plurality of image forming units further includes a driving unit driving the electrostatic-latent-image carrying member to rotate; and wherein the phase control unit includes a drive control unit controlling each driving unit to drive each electrostatic-latent-image carrying member to rotate, allowing the phase of each electrostatic-latent-image carrying member to be identical with each other.

14. The image forming device as claimed in claim 12, wherein the each of the plurality of image forming units further includes an exposure unit exposing the circumferential surface of the electrostatic-latent-image carrying member; and wherein the phase control unit includes an exposure-timing control unit controlling exposure timing at which each exposure unit exposes the circumferential surface of the electrostatic-latent-image carrying member.

15. The image forming device as claimed in claim 12, wherein the calibration-image generating unit controls the each of the plurality of image forming units to form the plurality of monochromatic calibration images over at least a half-cycle length of a circumference of the electrostatic-latent-image carrying member.

16. The image forming device as claimed in claim 3, wherein the each of the at least one data group includes at least three data elements.

17. The image forming device as claimed in claim 1, wherein the at least one predetermined kind of information includes density of the monochromatic calibration image;

wherein the measuring unit includes a density measuring unit measuring the density of the monochromatic calibration image, thereby obtaining density data; and wherein the color-registration correcting unit adjusts each of the plurality of image forming units based on the density data of the monochromatic calibration image.

18. The image forming device as claimed in claim 1, wherein the at least one predetermined kind of information includes a position of the monochromatic calibration image;

wherein the each of the plurality of image forming units is provided for each of a plurality of colors;

wherein the measuring unit includes a calibration-image-position measuring unit measuring the position of the monochromatic calibration image; and wherein the color-registration correcting unit adjusts the plurality of image forming units for aligning positions at which each of the plurality of image forming units forms a monochromatic image, thereby obtaining monochromatic images in the plurality of colors that are aligned with each other.

19. The image forming device as claimed in claim 1, wherein the image carrying member is a conveying belt for conveying the recording medium.

20. An image forming device for forming a multicolor image by superimposing a plurality of monochromatic images on a recording medium, the device comprising:

an image carrying member carrying an image;

a plurality of image forming units, each of the plurality of image forming units forming a monochromatic calibration image on the image carrying member;

a measuring unit measuring at least one predetermined kind of information with respect to the monochromatic calibration image, thereby obtaining measurement data of the monochromatic calibration image;

an abnormal-position storing unit storing positional data of a position at which the measurement data is abnormal; and a color-registration correcting unit adjusting the plurality of image forming units based on the measurement data whose positional data is not stored in the abnormal-position storing unit, thereby correcting color registration errors among a plurality of monochromatic images.

21. An image forming device for forming a multicolor image by superimposing a plurality of monochromatic images on a recording medium, the device comprising:

an image carrying member carrying an image;

a plurality of image forming units, each of the plurality of image forming units forming a monochromatic calibration image on the image carrying member;

a measuring unit measuring at least one predetermined kind of information with respect to the monochromatic calibration image, thereby obtaining measurement data of the monochromatic calibration image;

a measurement-data storing unit that stores the measurement data;

a measurement-data determining unit determining whether the measurement data stored in the measurement-data storing unit is either normal data or abnormal data; and a color-registration correcting unit adjusting the plurality of image forming units based on the normal data by excluding the abnormal data, thereby correcting color registration errors among a plurality of monochromatic images.

22. An image forming device for forming a multicolor image by superimposing a plurality of monochromatic images on a recording medium, the device comprising:

an image carrying member carrying an image;

a plurality of image forming units, each of the plurality of image forming units forming a monochromatic calibration image on the image carrying member;

a position detecting unit detecting a position of the monochromatic calibration image on the image carrying member;

a measuring unit measuring at least one predetermined kind of information with respect to the monochromatic calibration image, thereby obtaining measurement data of the monochromatic calibration image;

a measurement-data determining unit determining whether the measurement data is either normal data or abnormal data; and an abnormal-position storing unit storing positional data of the position of the monochromatic calibration image at which the measurement-data determining unit has determined that the measurement data is the abnormal data.

23. An image forming device for forming a multicolor image by superimposing a plurality of monochromatic images on a recording medium, the device comprising:

an image carrying member carrying an image;

an abnormal-position storing unit storing positional data of a position at which measurement data of a monochromatic calibration image on the image carrying member is abnormal;

a plurality of image forming units, each of the plurality of image forming units forming the monochromatic calibration image on the image carrying member, while avoiding the position whose positional data is stored in the abnormal-position storing unit;

a measuring unit measuring at least one predetermined kind of information with respect to the monochromatic calibration image, thereby obtaining the measurement data of the monochromatic calibration image; and a color-registration correcting unit adjusting the plurality of image forming units based on the measurement data obtained by the measuring unit, thereby correcting color registration errors among a plurality of monochromatic images.

24. An image forming device for forming a multicolor image by superimposing a plurality of monochromatic images on a recording medium, the device comprising:

an image carrying member carrying an image;

a plurality of image forming units, each of the plurality of image forming units forming a monochromatic calibration image on the image carrying member;

a measuring unit measuring at least one predetermined kind of information with respect to the monochromatic calibration image, thereby obtaining at least one data group of the at least one predetermined kind of information;

an abnormal-data excluding unit excluding abnormal data from each of the at least one data group, thereby obtaining normal data;

a color-registration correcting unit adjusting the plurality of image forming units based on the normal data, thereby correcting color registration errors among a plurality of monochromatic images; and a position detecting unit detecting a reference position on the image carrying member and obtaining an image forming position of the monochromatic calibration image on the image carrying member, the image forming position being a relative position with regard to the reference position;

wherein the abnormal-data excluding unit includes an abnormal-data determining unit determining whether each of the at least one data element is out of a predetermined range, thereby determining abnormal data;

wherein the abnormal-data excluding unit further includes an abnormal-position determining unit determining, as an abnormal position, the image forming position of the monochromatic calibration image at which abnormal data has been obtained; and wherein the abnormal-data excluding unit further includes an abnormal-position storing unit storing positional data of the abnormal position.

25. An image forming device for forming a multicolor image by superimposing a plurality of monochromatic images on a recording medium, the device comprising:

an image carrying member carrying an image;

a plurality of image forming units, each of the plurality of image forming units forming a monochromatic calibration image on the image carrying member;

a measuring unit measuring at least one predetermined kind of information with respect to the monochromatic calibration image, thereby obtaining at least one data group of the at least one predetermined kind of information;

an abnormal-data excluding unit excluding abnormal data from each of the at least one data group, thereby obtaining normal data;

a color-registration correcting unit adjusting the plurality of image forming units based on the normal data, thereby correcting color registration errors among a plurality of monochromatic images; and a position detecting unit detecting a reference position on the image carrying member and obtaining an image forming position of the monochromatic calibration image on the image carrying member, the image forming position being a relative position with regard to the reference position;

wherein the abnormal-data excluding unit includes an abnormal-data determining unit determining whether each of the at least one data element is out of a predetermined range, thereby determining abnormal data;

wherein the each of the plurality of image forming units is provided for each of a plurality of colors;

wherein the color-registration correcting unit includes:

a calibration-image generating unit generating a plurality of monochromatic calibration images in each of the plurality of colors and controlling each of the plurality of image forming units to form the plurality of monochromatic calibration images at predetermined intervals; and a normal-data-number determining unit determining whether the abnormal-data excluding unit has obtained at least three normal data of the monochromatic calibration images, the at least three normal data having positional data that are not stored in the abnormal-position storing unit, the at least three normal data having been determined to be in the predetermined range by the abnormal-data determining unit; and wherein, if the normal-data-number determining unit has determined that a number of the normal data obtained by the abnormal-data excluding unit is less than three, the calibration-image generating unit controls each of the plurality of image forming units to form a plurality of monochromatic calibration images at different positions on the image carrying member, the different positions being different from positions at which the plurality of image forming units has already formed the plurality of monochromatic calibration images, thereby allowing the color-registration correcting unit to repeat correcting color registration errors.

26. An image forming device for forming a multicolor image by superimposing a plurality of monochromatic images on a recording medium, the device comprising:

an image carrying member carrying an image;

a plurality of image forming units, each of the plurality of image forming units forming a monochromatic calibration image on the image carrying member;

a measuring unit measuring first kind of information and second kind of information with respect to the monochromatic calibration image, thereby obtaining a first data group of the first kind of information and a second data group of the second kind of information;

an abnormal-data excluding unit excluding abnormal data from each of the first data group and the second data group, thereby obtaining normal data of both the first kind of information and the second kind of information; and a color-registration correcting unit adjusting the plurality of image forming units based on the normal data of both the first kind of information and the second kind of information, thereby correcting color registration errors among a plurality of monochromatic images.

27. The image forming device as claimed in claim 26, wherein the first kind of information relates to a position of the monochromatic calibration image and the second kind of information relates to information other than the position of the monochromatic calibration image.

* * * * *